US008393404B2

(12) United States Patent
Ingraham

(10) Patent No.: US 8,393,404 B2
(45) Date of Patent: Mar. 12, 2013

(54) DOWNHOLE MULTIPLE BORE ROTARY DIVERTER APPARATUS

(75) Inventor: Derek Ingraham, Conroe, TX (US)

(73) Assignee: Smith International, Inc., Houston, TX (US)

( * ) Notice: Subject to any disclaimer, the term of this patent is extended or adjusted under 35 U.S.C. 154(b) by 378 days.

(21) Appl. No.: 12/771,273

(22) Filed: Apr. 30, 2010

(65) Prior Publication Data

US 2010/0276158 A1 Nov. 4, 2010

Related U.S. Application Data

(60) Provisional application No. 61/174,406, filed on Apr. 30, 2009.

(51) Int. Cl.

| | |
|---|---|
| ***E21B 23/00*** | (2006.01) |
| ***E21B 7/06*** | (2006.01) |
| ***E21B 23/03*** | (2006.01) |
| ***E21B 23/12*** | (2006.01) |

(52) U.S. Cl. ..... 166/386; 166/381; 166/241.1; 166/117.5; 175/61

(58) Field of Classification Search ..... 166/381, 166/386, 24.1, 52, 117.5; 175/61
See application file for complete search history.

(56) References Cited

U.S. PATENT DOCUMENTS

| | | | | |
|---|---|---|---|---|
| 2,362,529 | A * | 11/1944 | Barrett et al. | 166/55.3 |
| 5,129,459 | A | 7/1992 | Breese et al. | |
| 5,143,015 | A * | 9/1992 | Lubitz et al. | 166/187 |
| 5,377,762 | A * | 1/1995 | Turner | 166/339 |
| 5,878,815 | A * | 3/1999 | Collins | 166/313 |
| 6,009,942 | A * | 1/2000 | Williamson | 166/117.5 |
| 2005/0230151 | A1 | 10/2005 | McGarian | |

FOREIGN PATENT DOCUMENTS

| | | |
|---|---|---|
| GB | 2396168 A | 6/2004 |
| GB | 2396168 B | 1/2006 |

OTHER PUBLICATIONS

GB Examination Report to UK Application No. GB1007213.0 dated Feb. 2, 2012.

* cited by examiner

*Primary Examiner* — Cathleen Hutchins

(57) ABSTRACT

A downhole rotary diverter assembly includes multiple passages for selectively aligning with multiple boreholes. The diverter assembly can be selectively actuated to direct a tool or tubing through-passage toward a desired borehole. The primary tool through-passage of the diverter assembly can be alternately and continually aligned and re-aligned with a desired borehole out of multiple boreholes, while the diverter assembly remains in the well. After a single trip into the well, and placement of the diverter assembly in a well junction, the diverter assembly can be actuated to rotate flow passages into alignment with multiple boreholes. An actuation tool may be lowered into the diverter assembly and manipulated to activate a mandrel. The mandrel is guided by an indexing mechanism to rotatably cycle through discrete and predetermined alignment positions that correspond generally with the stop positions of a guide pin in a guide slot of the indexing mechanism.

25 Claims, 40 Drawing Sheets

DOWNHOLE MULTIPLE BORE ROTARY DIVERTER APPARATUS

CROSS-REFERENCE TO RELATED APPLICATIONS

The present application claims priority to and the benefit of U.S. provisional application Ser. No. 61/174,406 filed Apr. 30, 2009, entitled "Downhole Multiple Bore Rotary Diverter Apparatus".

BACKGROUND

This disclosure relates generally to hydrocarbon exploration and production, and in particular, to managing placement of wellbore tubulars and other tools in a borehole to facilitate hydrocarbon exploration and production.

A main borehole may be provided with one or more lateral boreholes which branch from the main borehole and extend the well into one or more directions laterally therefrom. During downhole operations, it may be necessary to separately and selectively enter the main and lateral boreholes with a wellbore tubular. For example, different tubular members, tools or other devices may need to be guided into and out of the main and lateral boreholes.

The principles of the present disclosure are directed to overcoming one or more of the limitations of the existing apparatus and processes for providing access to multiple boreholes in a single well.

SUMMARY

A rotary diverter assembly includes passages that can be selectively actuated to rotatably align with multiple boreholes. A primary tool through-passage of the diverter assembly can be alternately and continually aligned and re-aligned with a desired borehole out of multiple boreholes, while the diverter assembly remains in the well. With a single trip into the well and a well junction, the diverter assembly can be actuated to rotate flow passages into alignment with multiple boreholes. In one aspect, the diverter assembly includes an outer housing with an upper receptacle and a lower connector that form a chamber. A mandrel and diversion housing assembly is captured in the chamber and slidable between the lower connector and upper receptacle, while also being rotatable by the indexing mechanism to achieve selective alignment of the diversion housing passages with the bores below.

In certain embodiments, an actuation tool is lowered into the diverter assembly and manipulated to activate the mandrel. The mandrel is guided by an indexing mechanism to rotatably cycle through discrete and predetermined alignment positions that correspond generally with the stop positions of a guide pin in a guide slot of the indexing mechanism. The actuation tool is continually raised and lowered to selectively rotate the mandrel and indexing mechanism and thereby alternately align the flow passages of the diversion housing with selected boreholes.

The mandrel may include a locking assembly for securing and releasing the mandrel relative to the housing or upper receptacle of the diverter assembly. The lower connector of the diverter assembly may include a releasable latching assembly for connecting the diverter assembly into a packer or other installed downhole device and then releasing the diverter therefrom.

An embodiment of the rotary diverter assembly for selectively aligning with multiple boreholes includes an outer housing, a mandrel slidably and rotatably disposed in the outer housing, the mandrel including a diversion housing having a first passage and a second passage, and an indexing mechanism disposed between the mandrel and the outer housing to rotatably align the each of the first and second passages of the diversion housing with the multiple boreholes in response to an axial force. Another embodiment includes an outer housing having an upper receptacle and a lower connector, a mandrel disposed in the outer housing between the upper receptacle and the lower connector, the mandrel including a diversion housing having a first passage and a second passage, and an indexing mechanism disposed between the mandrel and the outer housing, wherein the mandrel is axially moveable between the upper receptacle and the lower connector and rotatable in response to the axial movement via the indexing mechanism.

An embodiment for a method for selectively aligning a rotary diverter assembly with multiple boreholes includes lowering the diverter assembly into a well, aligning the diverter assembly on an installed downhole device, latching the diverter assembly into the installed downhole device to position the diverter assembly in a junction between a main borehole and a lateral borehole, wherein a first passage of the diverter assembly is aligned with the lateral borehole and the second passage of the diverter assembly is aligned with the main borehole, performing a downhole operation in the lateral borehole through the first passage, axially moving a mandrel including the first and second passages, rotating the mandrel and the first and second passages with an indexing mechanism in response to the axially moving, and re-aligning the first passage with the main borehole and the second passage with the lateral borehole.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
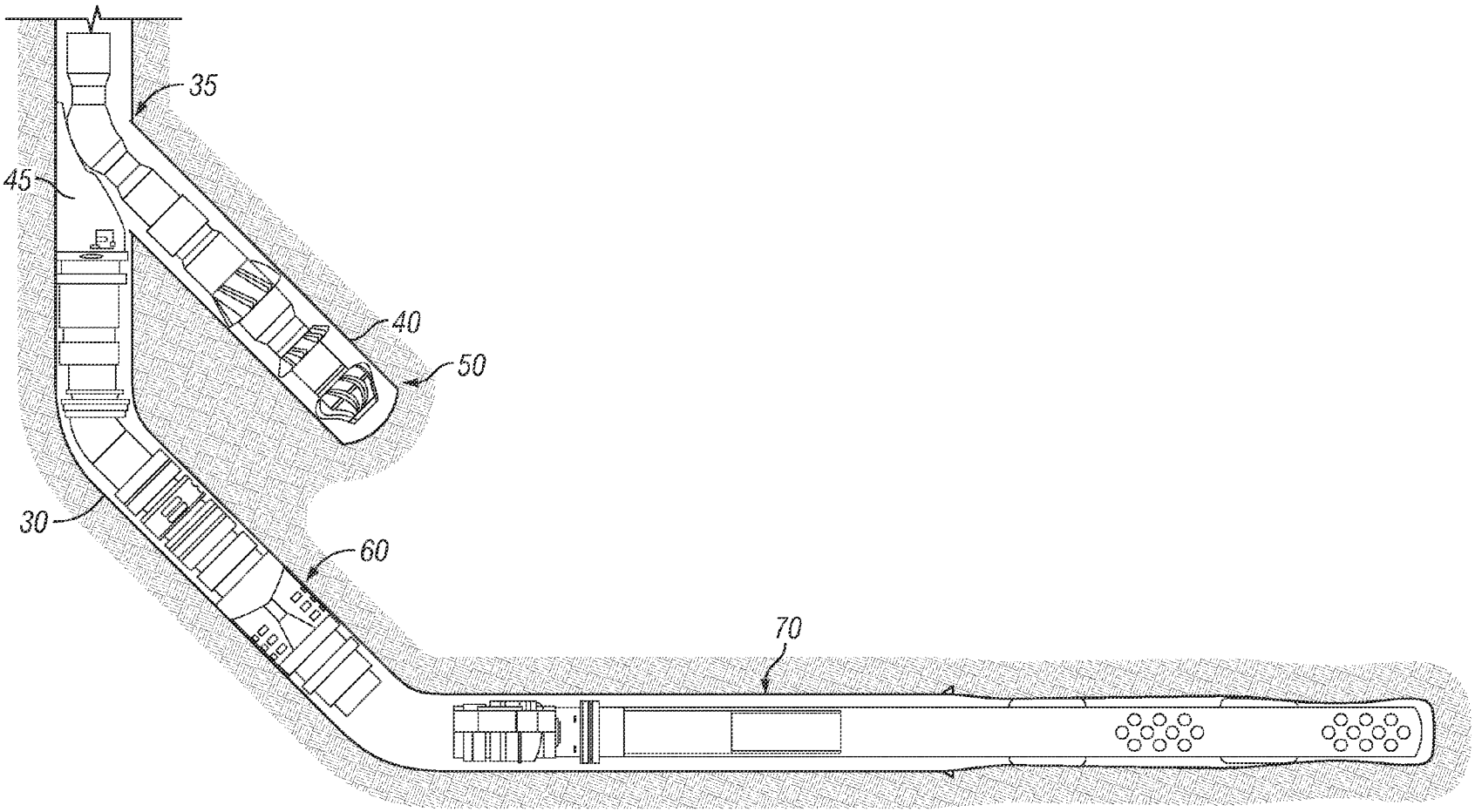
FIG. 1 is a schematic view of a system for milling and drilling a lateral borehole from a primary borehole.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, any use of any form of the terms "connect", "engage", "couple", "attach", or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". The terms "pipe," "tubular member," "casing" and the like as used herein shall include tubing and other generally cylindrical objects. In addition, in the discussion and claims that follow, it may be sometimes stated that certain components or elements are in fluid communication or fluidicly coupled. By this it is meant that the components are constructed and interrelated such that a fluid could be communicated between them, as via a passageway, tube, or conduit. The various characteristics mentioned above, as well as other features and characteristics described in more detail below, will be readily apparent to those skilled in the art upon reading the following detailed description of the embodiments, and by referring to the accompanying drawings.

Figure 2:
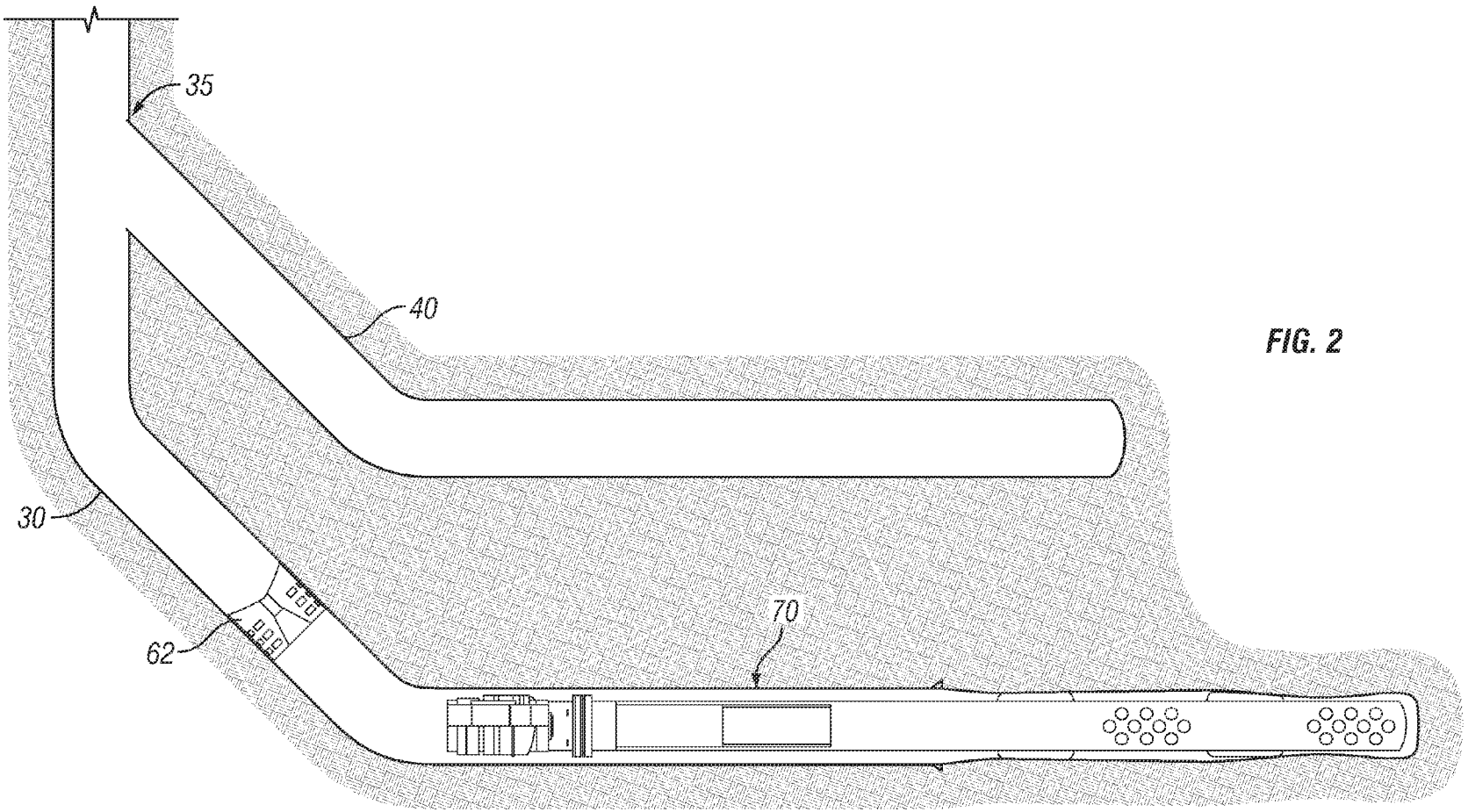
FIG. 2 is a schematic view of the finished junction between the lateral borehole and the primary borehole including downhole operations equipment.

Referring initially to FIG. 1, a primary or main borehole 30 is drilled and may then be equipped to include operational equipment 60, such as a whipstock and anchor system, and 70, such as a fracturing or production system. A diverter or whipstock 45 is used to guide a milling and/or drilling assembly 50 laterally relative to the primary borehole 30 for creating a lateral or secondary borehole 40 having a junction 35 with the primary borehole 30. Referring now to FIG. 2, the finished junction 35 and lateral borehole 40 is shown. Well treatment, completion or production equipment 70 may remain in the primary borehole 30 along with an orientator or locator 62 for receiving additional downhole tools.

Figure 3:
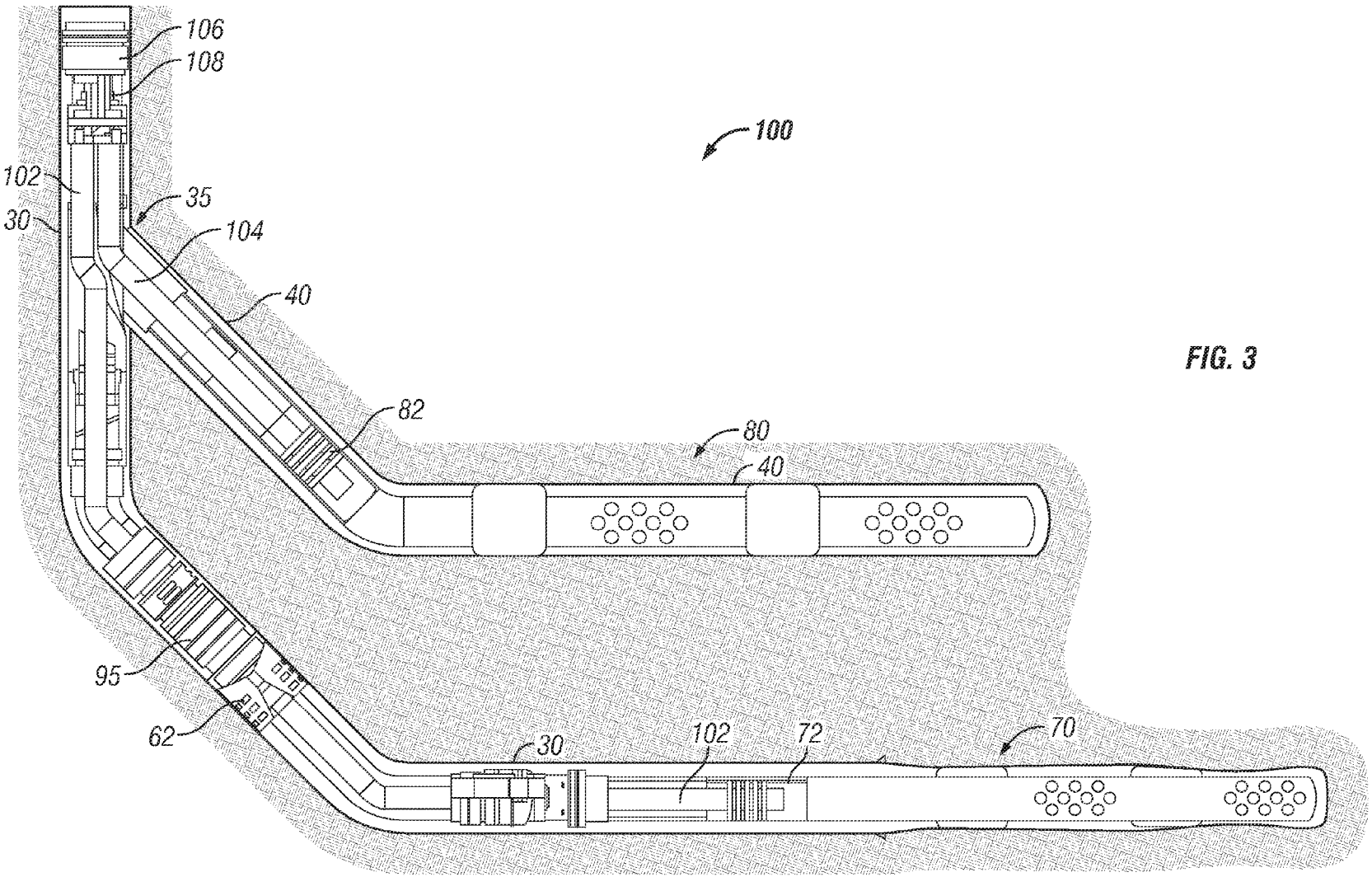
FIG. 3 is a schematic view of an embodiment of a dual production string assembly in accordance with principles herein disposed in the junction of FIG. 2.

Referring next to FIG. 3, an exemplary tubing system or assembly 100 is shown positioned in the junction 35 for isolating the lateral borehole 40 from the main borehole 30 and vice versa, as well as for providing access to the two (or multiple) bores for re-entry, intervention or production access. The tubing assembly 100 may also be referred to as a junction block, or a Y-block. A packer 106, with a seal bore receptacle, is set at the top of the junction block 100 to latch the junction block 100 into the top of the junction 35. When latched, multiple tubing strings 102, 104 are advanced into the junction 35. The string 102 lands in a polished bore receptacle 72 of the production equipment 70 and the string 104 lands in a polished bore receptacle 82 of production equipment 80. For purposes of simplicity and clarity, the strings 102, 104 and the equipment 70, 80 will be referred to as production strings and equipment, though other tubular members and downhole equipment are contemplated. The positioned assembly 100 and production strings 102, 104 may effect a seal in the bores of the production equipment 70, 80 in the main and lateral bores to complete the well. A packer assembly 95 and other downhole equipment may also be provided in the boreholes 30, 40. The junction block 100, outfitted with the various embodiments of a rotary diverter apparatus as described herein, is designed to provide a stackable level 5 junction wherein one completed junction 35 can be stacked on top of another completed junction 35. Further details of the rotary diverter apparatus will now be explained.

In some embodiments, a rotary diverter apparatus 108 is disposed at the top of the junction block 100 that selectively allows access to either bore via the strings 102, 104 for future intervention work needed downhole. The diverter 108 may stay in place and can be rotated by mechanisms further described herein to allow access to the desired bore. The diverter 108 can be rotated 180 degrees from the original position, aligning the access tubing to the opposite bore. The in-place diverter 108 can be used, but not limited, to selectively allow access in a level 5 junction that has a lateral bore and a main bore. As will become evident with additional details below, the diverter allows individual access to two or more different bores without having to make any additional trips to the surface. The diverter also does not need any special equipment to enter one bore versus the other bore. The diverter allows the level 5 junction to be stacked, creating two level 5 completion assemblies. If another junction is created in the main borehole 30 above the original junction 35, a packer is provided to seal access to the lower junction 35, making the junction block 100 stackable.

Figure 4:
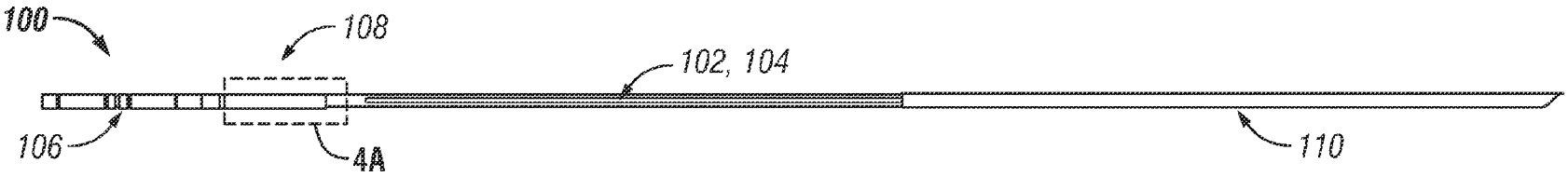
FIG. 4 is a side view of an embodiment of a production string assembly in accordance with principles herein.
Figure 4A:
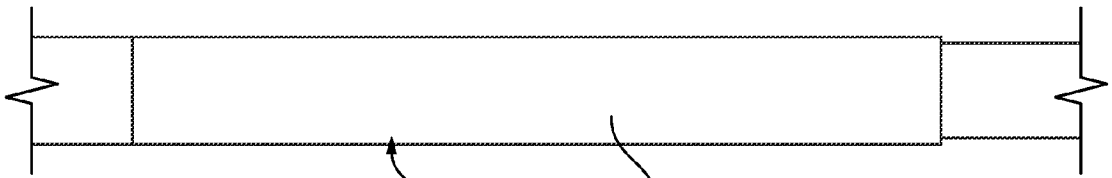
FIG. 4A is an enlarged view of a diverter assembly of FIG. 4.
Figure 5:
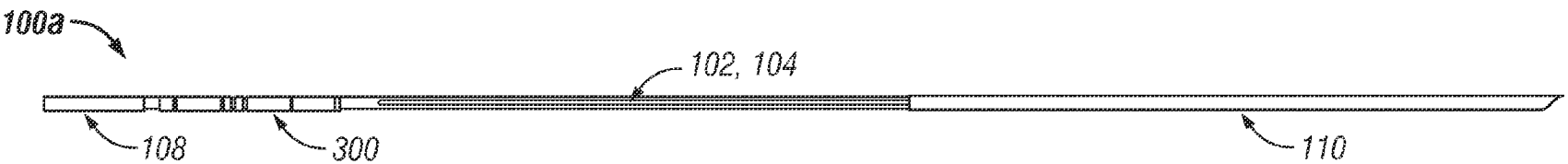
FIG. 5 is an alternative embodiment of a production string assembly in accordance with principles herein.

Referring now to FIG. 4, a side view of the junction assembly 100 is shown. An upper end of the assembly 100 includes the packer 106, followed by the diverter 108, the tubing strings 102, 104 and a tubing shroud 110. The enlarged inset view of FIG. 4A shows the outer body 112 of the diverter 108. Referring to FIG. 5, an alternative arrangement of the junction assembly is shown. The junction assembly 100*a* instead includes the diverter 108 at the upper end of the assembly, followed by a packer 300, the tubing strings 102, 104, and the tubing shroud 110.

Figure 6:
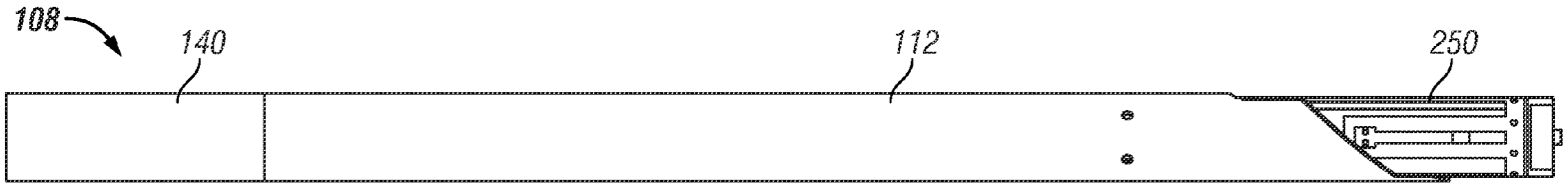
FIG. 6 is a side view of the diverter assembly.
Figure 7:
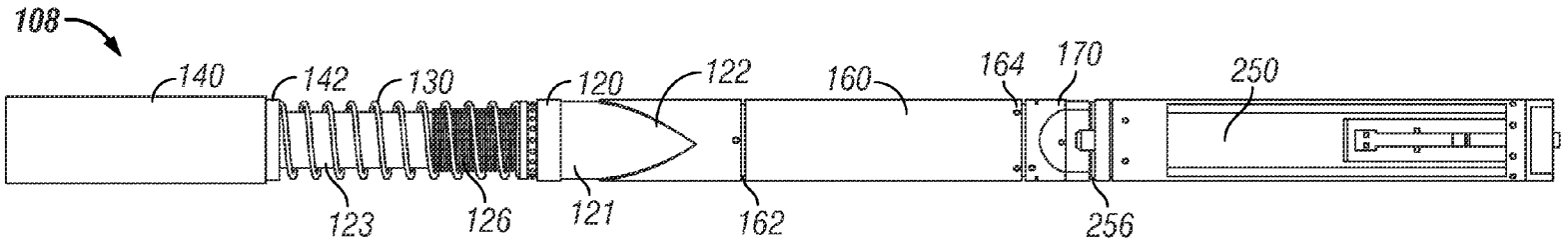
FIG. 7 is the diverter assembly of FIG. 6 with the outer housing removed.

Referring to FIGS. 6-9, the diverter assembly 108 includes the outer body, housing or surface 112, an upper receptacle housing 140 and a lower bore housing and connector 250. In FIG. 7, with the housing 112 removed, the diverter 108 is shown to include a hollow mandrel or cylindrical member 120 having a reduced diameter upper portion 123 and an increased diameter lower portion 121. Surrounding the portion 123 are a sleeve 126 and a biasing spring 130. The outer surface of the portion 121 includes a guide groove or J-slot 122 formed therein. A lower tubular member 160 is coupled to the portion 121 at a coupling 162. The lower tubular member 160 is coupled to a diversion housing 170 at a coupling 164. The diversion housing 170 is coupled to the lower connector 250 at a coupling 256. The upper receptacle housing 140 is slidably coupled to the diverter mandrel portion 123 at a coupling 142, such that the diverter mandrel 120 can slide within the housing 140.

Figure 8:
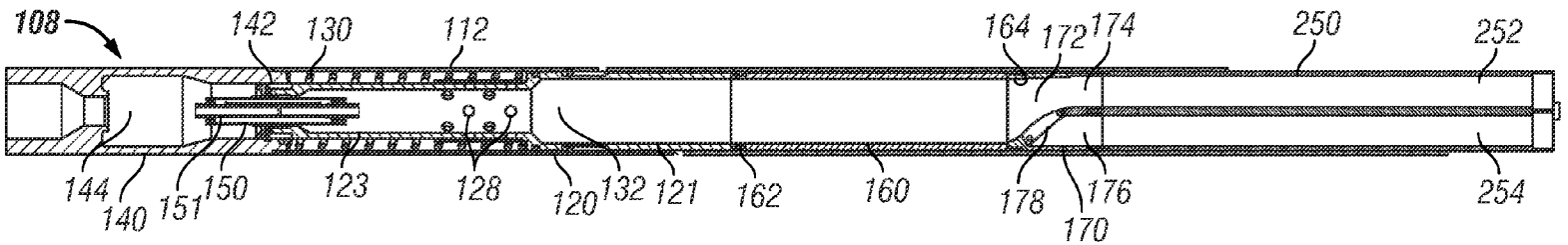
FIG. 8 is a longitudinal cross-section view of the diverter assembly of FIG. 6.
Figure 9:
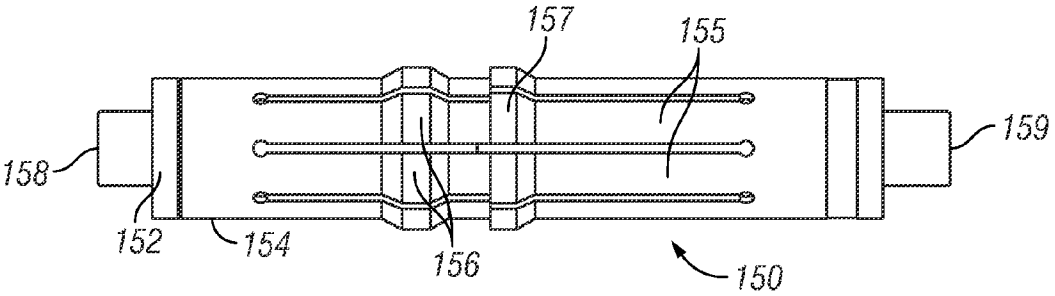
FIG. 9 is an enlarged side view of an actuation tool in FIG. 8.

Referring next to the cross-section view of FIG. 8, the upper receptacle 140 is adapted to receive a diverter operational or actuation tool 150. The actuation tool 150 may be a wireline diverter operational tool in some embodiments, while other embodiments may include an Ottis B Shifting Tool. The actuation tool 150 includes a through-passage 151, and as seen in FIG. 9, an inner member 152 and an outer housing 154. The inner member 152 may be a tubular member having an upper connector 158 connectable to an upper tool. In some embodiments, the upper tool is a wireline tool. In some embodiments, the upper tool is a Welltec Tractor and Stroker tool run above the actuation tool 150. The inner member 152 also includes a lower connector 159 connectable to other tools run below the tool 150. The outer housing 154 includes expandable and collapsible collets 155 having upper shoulders 156 and lower shoulders 157.

Referring back to FIG. 8, the actuation tool 150 is insertable into the upper mandrel portion 123 via an opening that is part of a through-passage 132. The portion 123 includes holes or ports 128. The diversion housing 170 is a dual fluid passage diversion housing including a primary through-passage 172 that is split into a first passage 174 and a second passage 176 at the lower end of the housing 170. Coupled into the housing 170 between the primary passage 172 and the second passage 176 is a blocker or diverter 178 that blocks passage of objects, such as the tool 150, into the second passage 176 while still allowing fluid flow therethrough. The housing 170 is coupled to the lower bore housing 250 such that a first flow bore or passage 252 is aligned with the first passage 174 and a second flow bore or passage 254 is aligned with the second passage 176.

Figure 10:
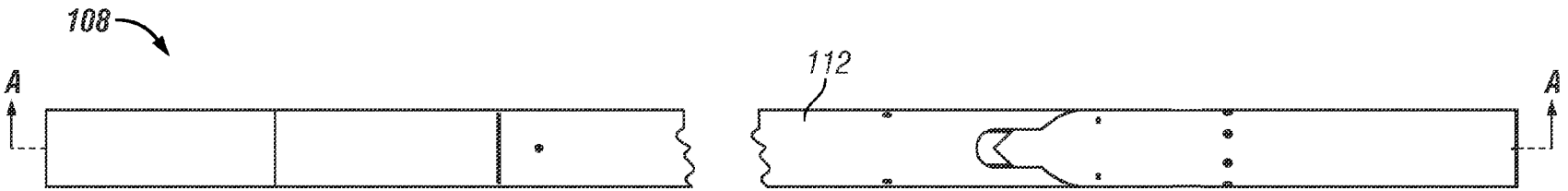
FIGS. 10-14 are additional side views of the diverter assembly of FIGS. 6-8.
Figure 12:
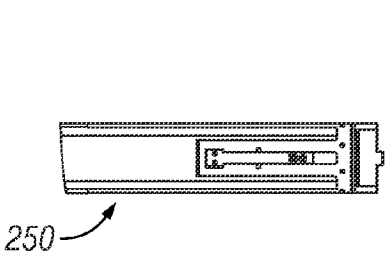
Figure 11:
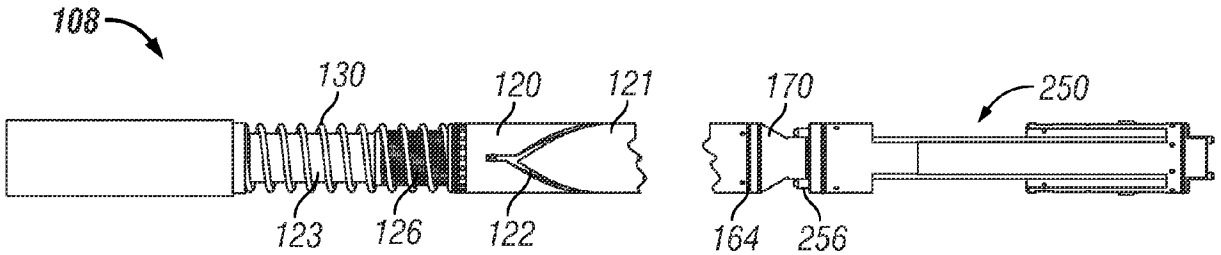
Figure 13:
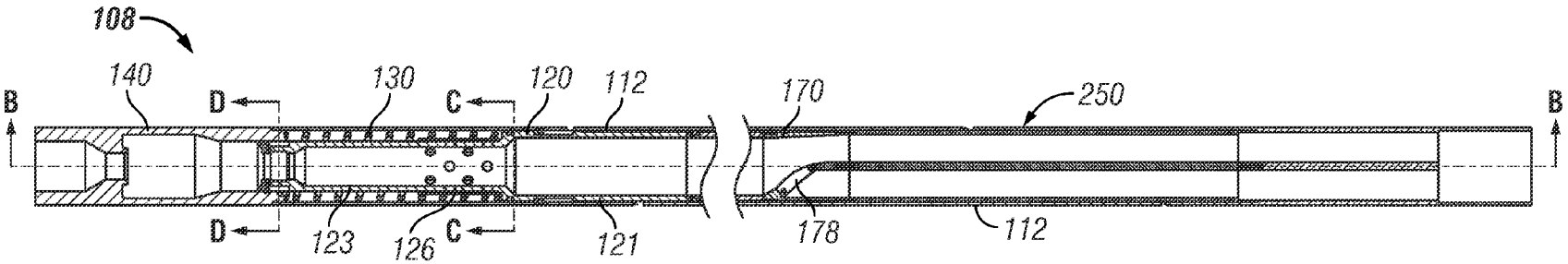
Figure 14:
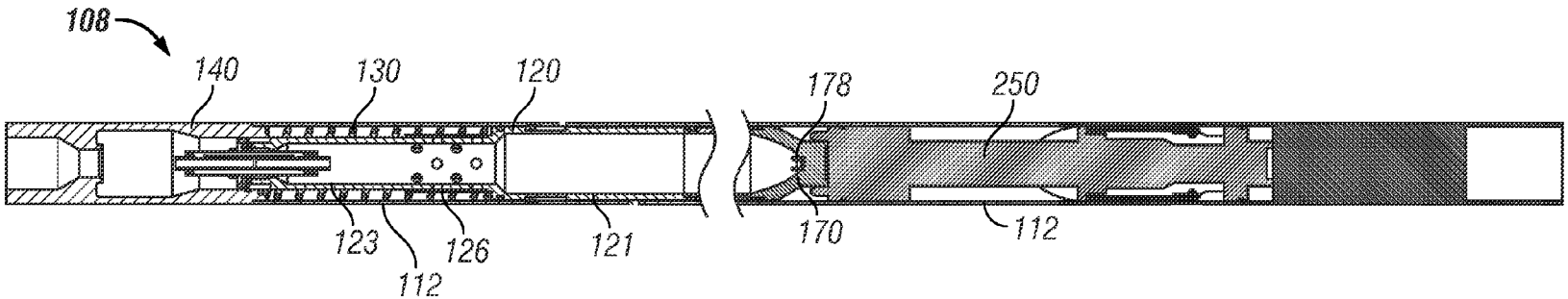
Figure 15:
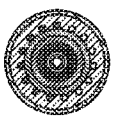
FIG. 15 is a radial cross-section view of the diverter assembly taken at D-D of FIG. 13.
Figure 16:
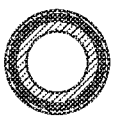
FIG. 16 is a radial cross-section view of the diverter assembly taken at C-C of FIG. 13.

FIGS. 10-22 show further details of the assembly views of the diverter 108 of FIGS. 6-9. In FIG. 10, the view of FIG. 6 is rotated 90 degrees. Likewise, FIG. 11 shows a 90-degree rotation of the view of FIG. 7, particularly with rotated views of the guide slot 122 and the diversion housing 170. FIG. 12 shows an unrotated view of the lower portion of the diverter 108, as seen in FIG. 7, including the lower connector 250. FIG. 13 shows a cross-section view of the diverter tool 108 similar to that of FIG. 8, with additional details. FIG. 15 is a radial cross-section view of the tool 108 of FIG. 13 taken at the section D-D. FIG. 16 is a radial cross-section view of the diverter 108 of FIG. 13 taken at the section C-C. FIG. 14 shows a cross-section view of the diverter 108 similar to that of FIGS. 8 and 14, with the diverter 108 rotated 90 degrees. The diversion housing 170 is shown from a different viewpoint.

Figure 17:
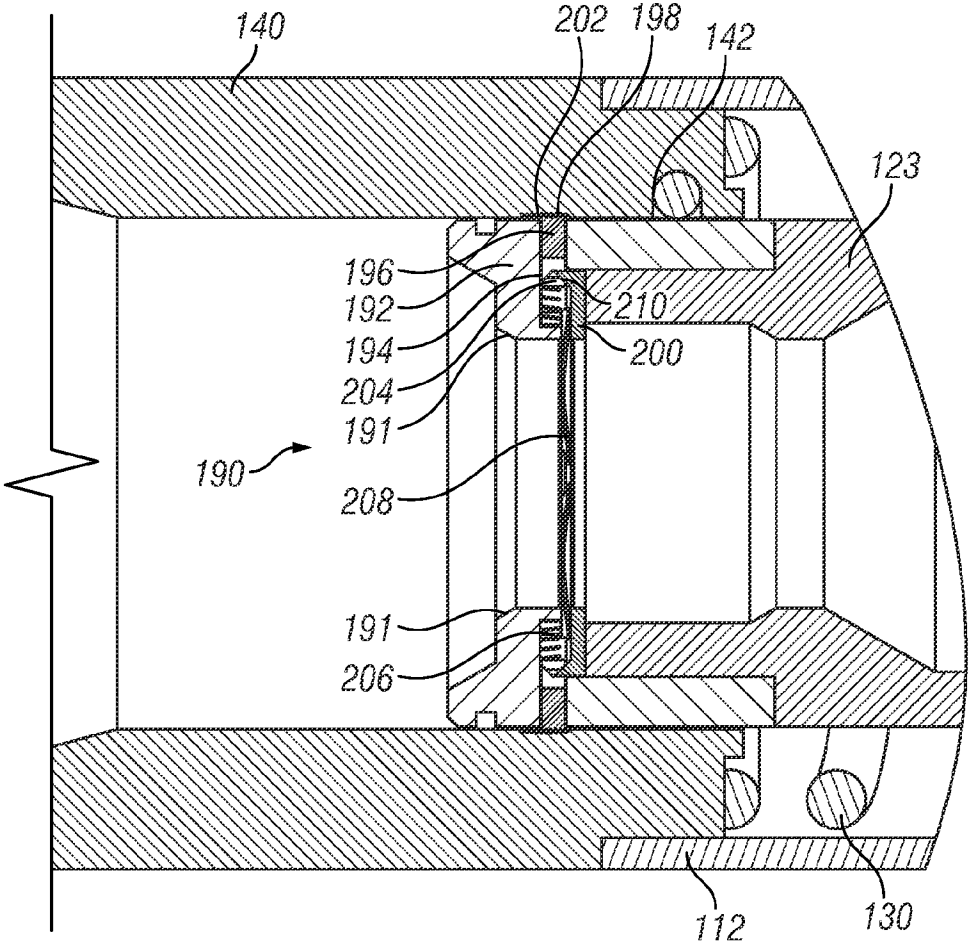
FIGS. 17-19 show details of a locking assembly of the detail A of FIG. 13.
Figure 19:
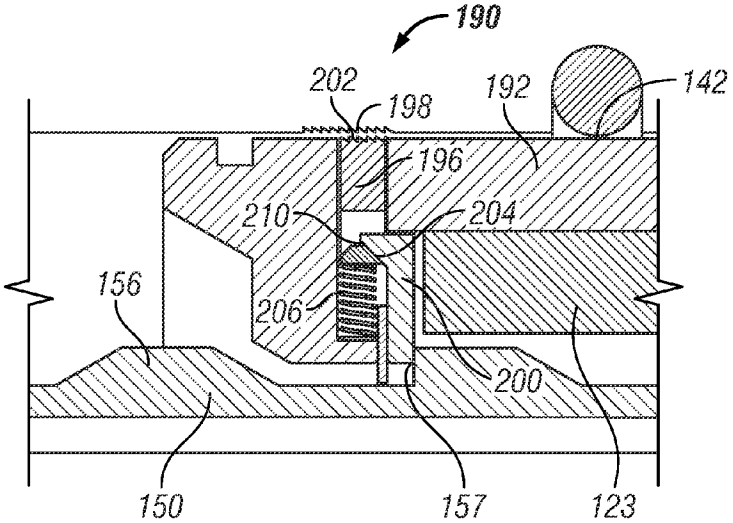
Figure 18:
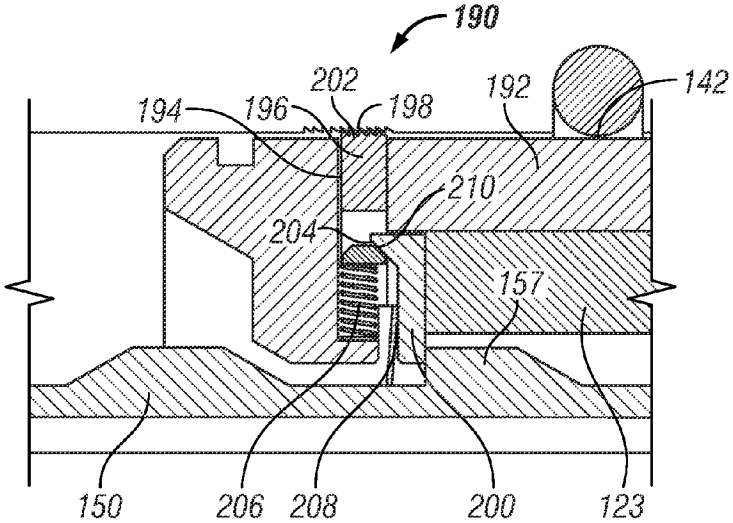

Referring to FIGS. 17-19, the detail A of FIG. 13 is shown enlarged. Disposed between the portion 123 of the diverter mandrel 120 and the upper receptacle 140 is a locking assembly 190. The assembly 190 includes a retainer 192 having slots 194 retaining locking members 196. The locking members 196 include locking teeth 198 that mate and interlock with mating teeth 202 on the inner surface of the receptacle 140 when in a locked position. The assembly 190 also includes an actuation member 200 having angled surface projections 210 that engage angled surfaces 204 of the locking members 196. Biasing springs 206 are actively engaged between the locking members 196 and the retainer 192. A spacer or contact member 208 is disposed between the actuation member 200 and the retainer 192.

In FIG. 18, a portion of the FIG. 17 locking assembly 190 is enlarged to show the details of the locking assembly 190 in a locked position. The locked position may be achieved when the mandrel 120 and the receptacle 140 of the diverter 108 are engaged with the actuation tool 150 as shown in FIGS. 8 and 14. The biasing spring 206 forces the locking member 196 radially outward such that the interlocking teeth 198, 202 are matingly engaged to provide a locked relationship between the mandrel 120 and the receptacle 140. As shown in FIG. 19, the actuation tool 150 may be moved axially upward to engage the shoulder 157 of the tool 150 with the actuation member 200. Continued movement of the shoulder 157 will force the angled projection 210 of the actuation member 200 to slide along the angled surface 204 of the locking member 196. This angled sliding action forces the locking member 196 radially inward and compresses the biasing spring 206. The mating teeth 198, 202 are now released from each other, and the assembly 190 that is coupled to the mandrel 120 is in a released or unlocked position relative to the receptacle 140. The axial movement of the actuation member 200 also compresses or causes contact with the member 208 between the actuation member 200 and the retainer 192.

Figure 22:
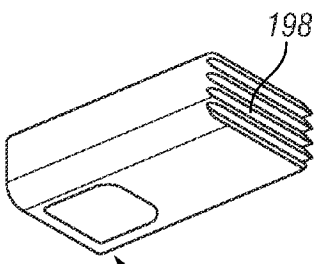
FIGS. 20-22 are perspective views of the actuation member, the spacer, and the locking member of the locking assembly of FIGS. 17-19.
Figure 21:
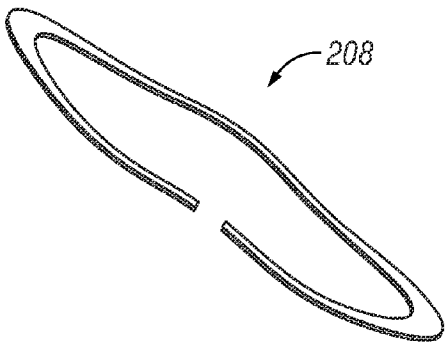
Figure 20:
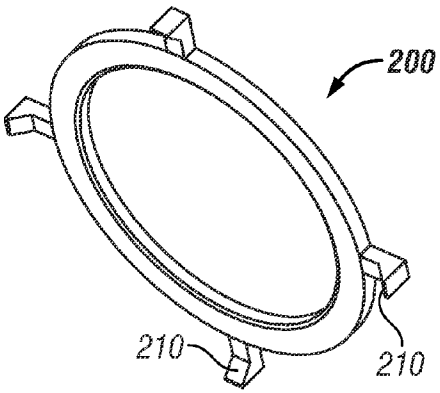

Referring to FIGS. 20-22, components of the locking assembly 190 are shown in more detail. In FIG. 20, the actuation member 200 is a ring having the angled projections 210. In FIG. 21, the spacer or contact member 208 is a broken ring. In FIG. 22, the locking member 196 is a block having locking teeth 198 and an opening for the angled engagement surface.

Figure 23:
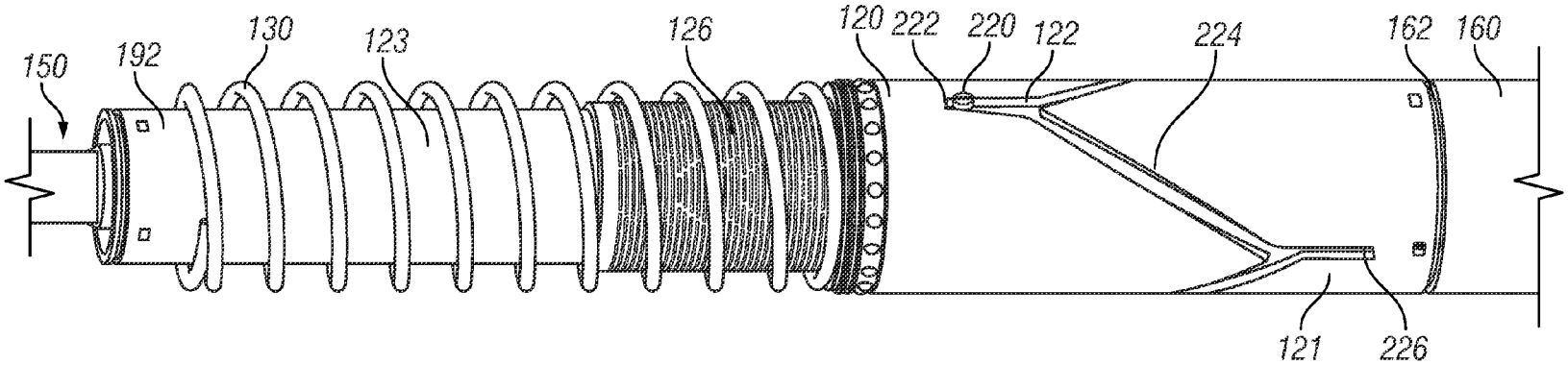
FIGS. 23-25 are various views of the diverter mandrel assembly of the diverter assembly of FIGS. 7-8 and 13-14.
Figure 25:
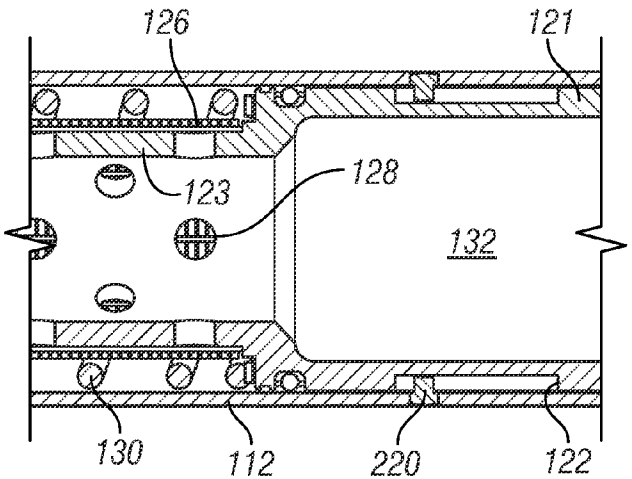
Figure 24:
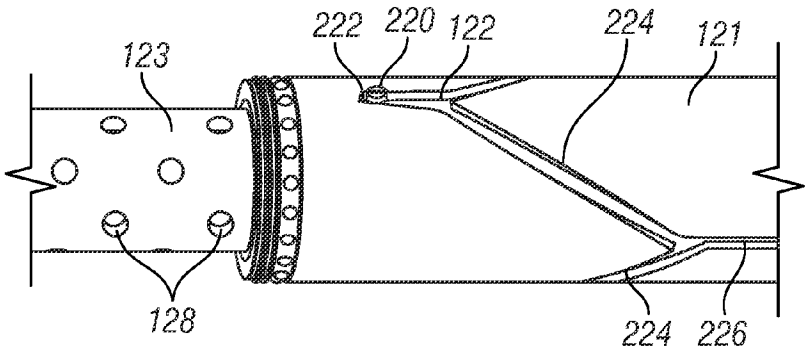
Figure 27:
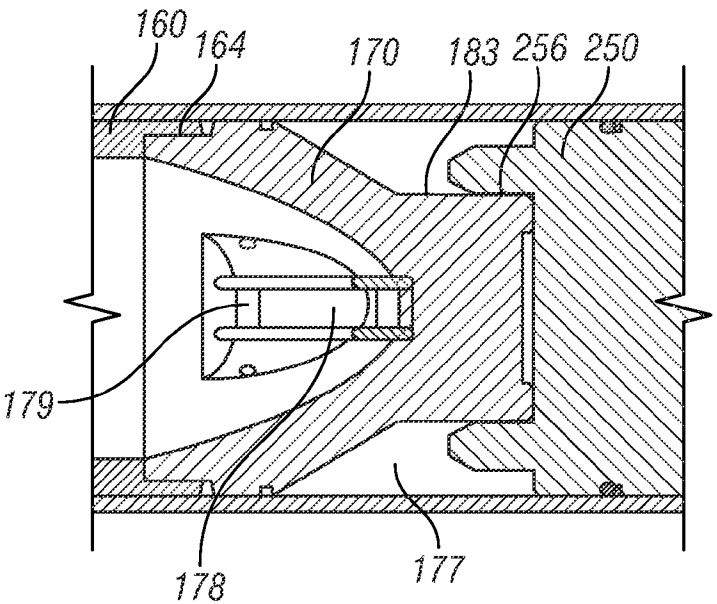
FIGS. 26-32 are various views of the flow passage diversion housing of the diverter assembly of FIGS. 7-8 and 13-14.

Referring now to FIGS. 23-25, further details of the diverter mandrel assembly 120 are shown. In FIG. 23, the actuation tool 150 is shown engaged in the retainer 192 and upper mandrel portion 123. Surrounding the portion 123 are the biasing spring 130 and the sleeve 126. As shown in FIGS. 24 and 25, the sleeve covers the ports 128. Associated with the lower mandrel portion 121 is an indexing mechanism comprising the guide groove or J-slot 122 and the corresponding guide pin or nut 220. As shown in FIG. 25, the guide pins 220 are affixed in the outer housing 112 such that as the hollow diverter mandrel 120 is moved axially relative to the housing 112 and the pin 220, the mandrel 120 also rotates about its longitudinal axis. The moveable mandrel 120 is allowed to rotate as the fixed guide pins 220 are guided through the several stop or indexed positions 222, 226 and the intermediate angled slots 224. In other embodiments, the fixed guide pins are disposed on the surface of portion 121 and the indexing slot is disposed on the inner surface of the housing 112 such that the mandrel 120 and guide pins move axially and rotationally relative to the housing 112 while the guides pins cycle through the various stop positions 222, 226 and angled slots 224 of the indexing slot 122.

Figure 26:
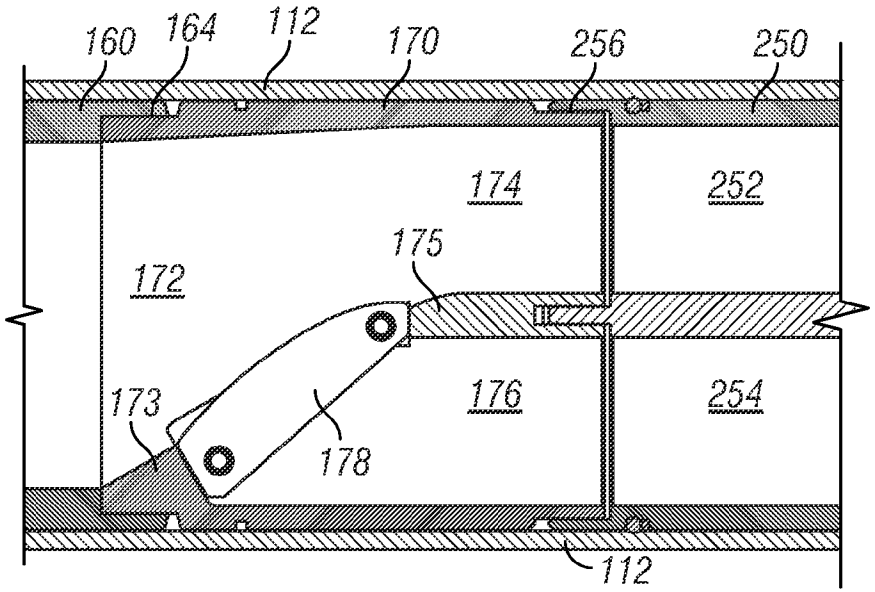
Figure 29:
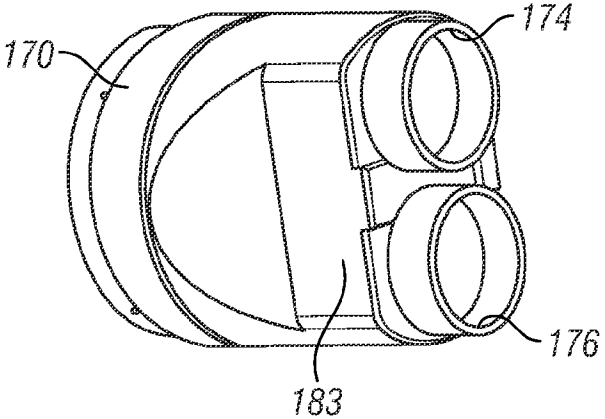
Figure 32:
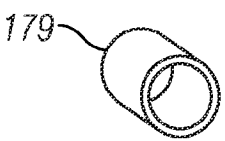
Figure 31:
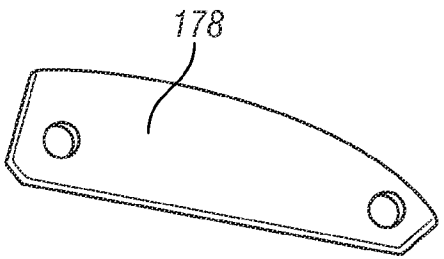
Figure 28:
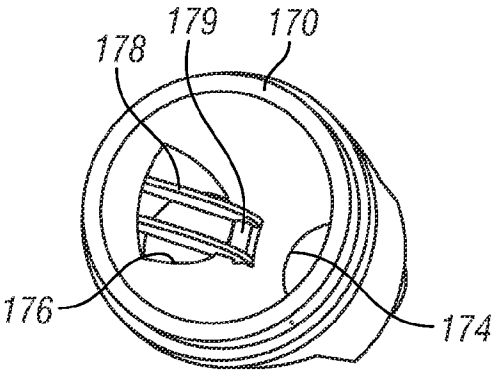
Figure 30:
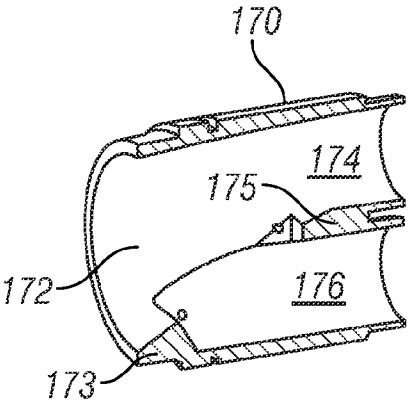

Referring now to FIGS. 26-32, further details of the flow passage diversion housing 170 are shown. In FIG. 26, the detail B from FIG. 13 is shown enlarged. The housing 170 is coupled at 164 to tubular 160 and coupled at 256 to the lower bore housing 250. The assembly is protected by outer housing 112. The housing 170 provides an upper primary flow passage 172 that splits into two lower passages 174, 176. The passage 174 is aligned with flow bore 252 and the passage 176 is aligned with flow bore 254. The blocker or diverter 178 is coupled between a shoulder 173 and a splitter 175. In the alternative cross-section view of the housing 170 in FIG. 27, the diverter 178 is shown connected by couplers 179 (FIG. 32). The diverter 178 comprises several reduced width blades (FIG. 31) that block only a portion of the passage 176 such that fluid is allowed to pass the diverter 178 while large, solid objects are deflected into the passage 174. A debris collection area 177 is provided by the reduced width portion 183 of the housing 170. Several other views of the housing 170, the passages 172, 174, 176 and the diverter 178 are shown in FIGS. 28-30.

Figure 33:
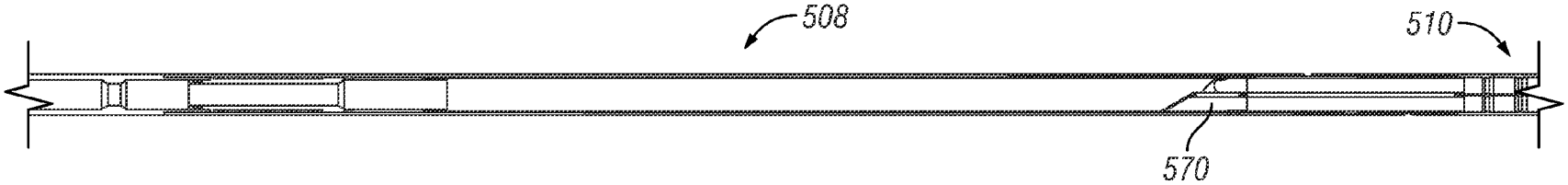
FIGS. 33-35 are various views of an alternative embodiment of the flow passage diversion housing.
Figure 34:
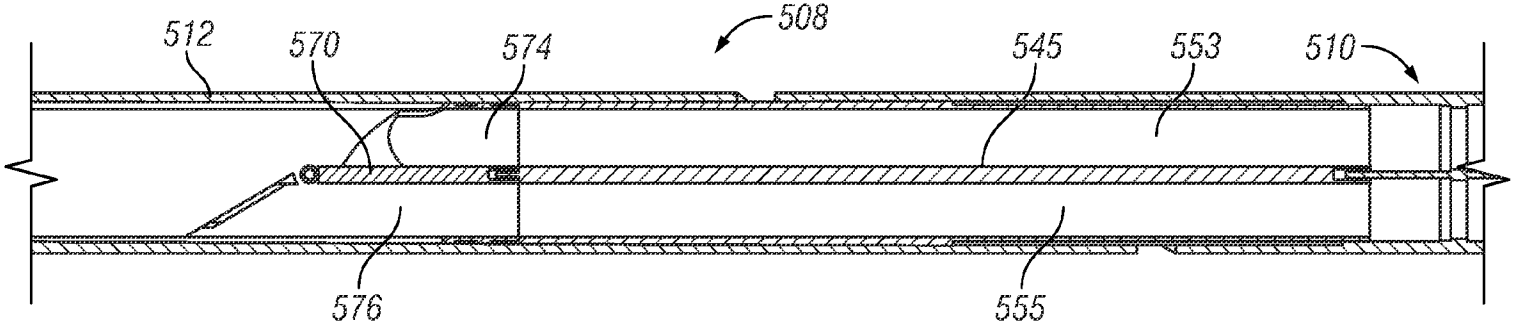
Figure 35:
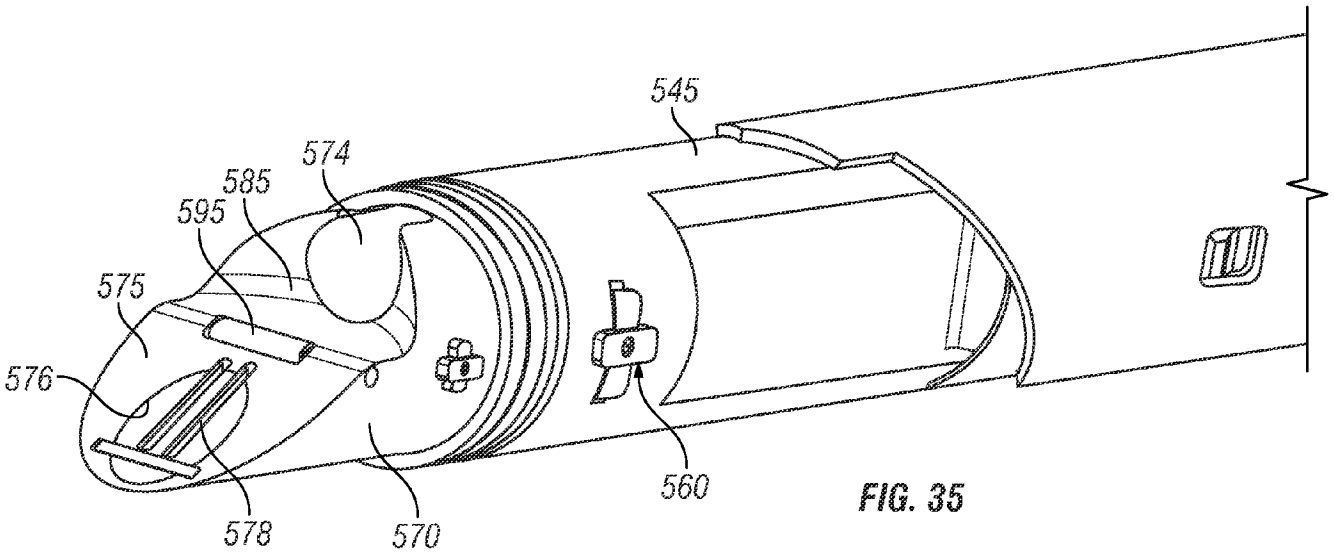

Another embodiment of a diversion housing is shown in FIGS. 33-35. A diverter assembly 508 is coupled to a dual bore packer 510 in a manner similar to those described herein. An alternative diversion housing 570 is coupled between the diverter 508 and the packer 510 as shown in the longitudinal cross-section view of FIG. 33. In the enlarged view of FIG. 34, the diversion housing 570 includes a first flow passage 574 fluidicly coupled to a first flow bore 553 of a lower connector 545 and a second flow passage 576 fluidicly coupled to a second flow bore 555 of the lower connector 545. In the enlarged perspective view of FIG. 35, the diversion housing 570 includes an angled surface 575 including a diverter or grate 578 disposed across the opening to the passage 576, a roller 595, and a funnel recess 585 disposed around the opening to the passage 574. The roller 595 and the funnel recess 585 aid in directing tubulars or tools into the passage 574 for future operations or runs. The lower connector 545 further includes a connecting means 560 for coupling to a housing 512.

Figure 36:
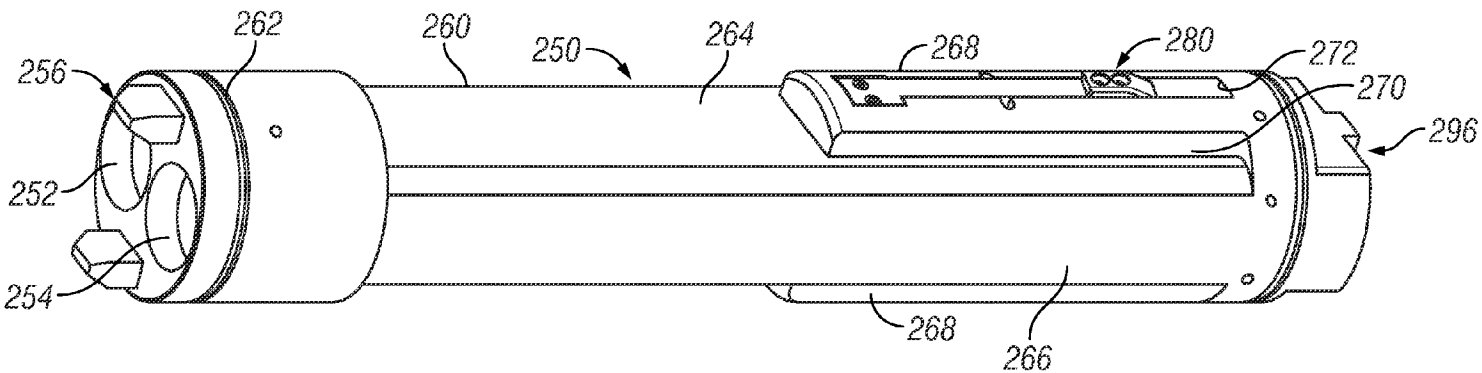
FIGS. 36-52 are various views of the flow bore housing and connector assembly of FIGS. 7-8 and 13-14, including the connector assembly coupled with the packer assembly.
Figure 39:
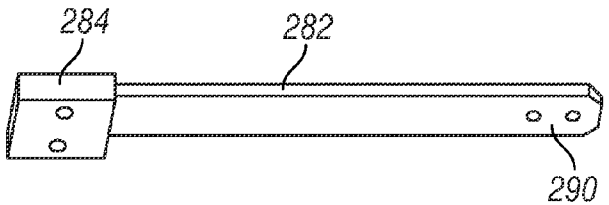

Referring now to FIGS. 36-52, further details of the flow bore housing and connector assembly 250 are shown. Referring first to FIG. 36, the housing 250 includes a body 260 having an upper end 262 including the connector 256, a middle reduced portion 264 providing a debris collection area, and lower end 266 including splines, ridges or ribs 268 and reduced portions 270 serving as debris collection areas. The lower end 266 also includes a connector 296. The ribs 268 include a pocket 272 having a latch dog assembly 280 disposed therein.

Figure 40:
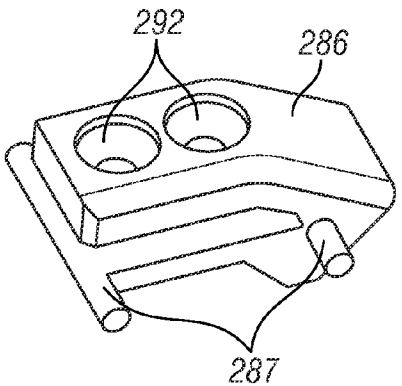
Figure 37:
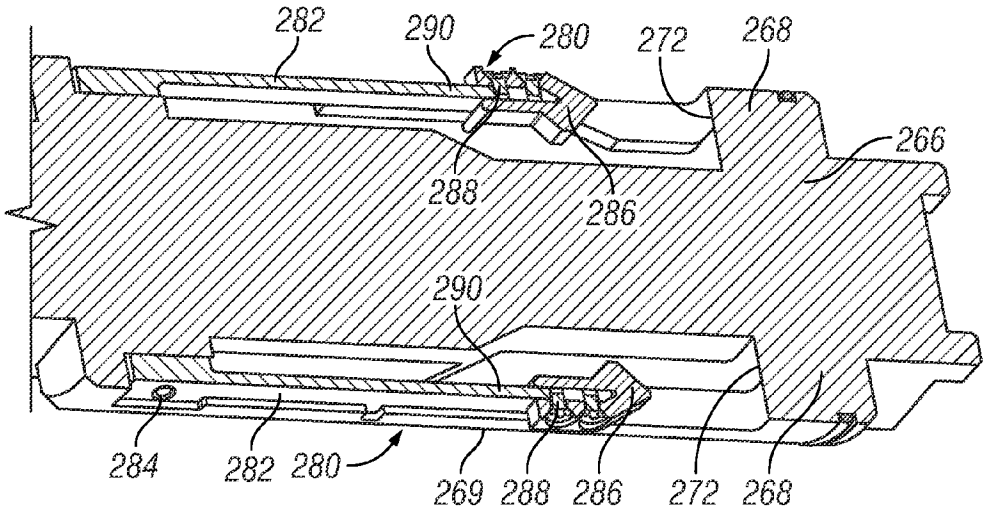
Figure 38:
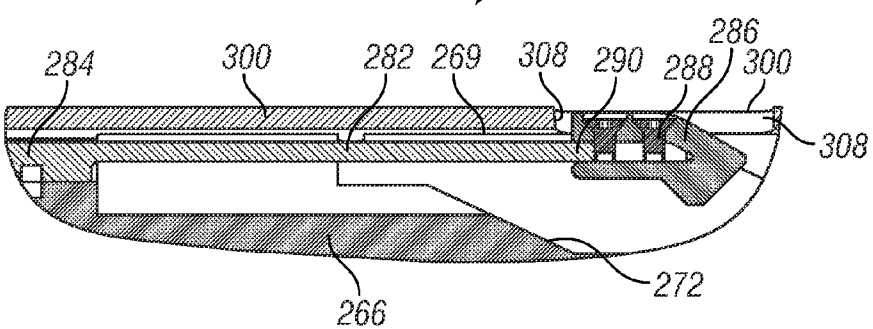

With reference to FIG. 37, the cross-section view of the lower end 266 shows several latch dog assemblies 280, each disposed in a pocket 272. Each assembly 280 includes an elongate support member 282 (FIG. 39) having a coupled end 284 and a free end 290 to which is coupled the latch dog 286 by shear screws 288. The latch dog 286, as shown in FIG. 40, includes bores 292 to receive the shear screws 288 and side projections 287. Because the latch support member 282 is flexible, and the end 284 is coupled to the lower end 266 in the pocket 272 and the end 290 is free, the latch support member 282 acts as a leaf spring to allow radial movement of the latch dog 286 in the pocket 272 while biasing the latch dog 286 to the position shown in FIGS. 37 and 38. In such biased position, the latch dog 286 includes an outermost radial surface that is positioned beyond an outer surface 269 of the rib 268, as is best shown in FIG. 38.

Figure 41:
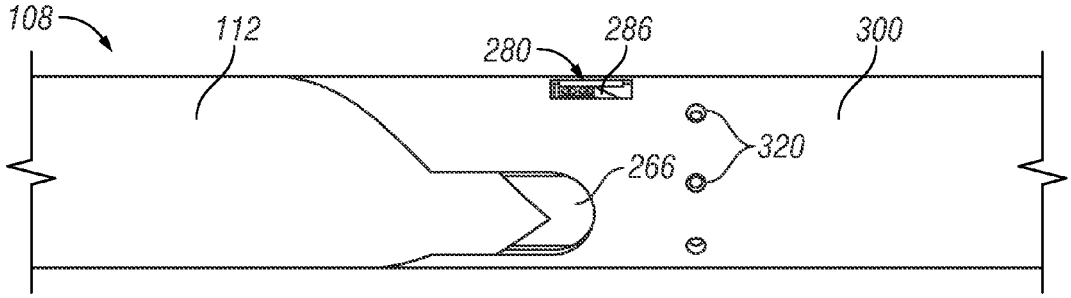
Figure 42:
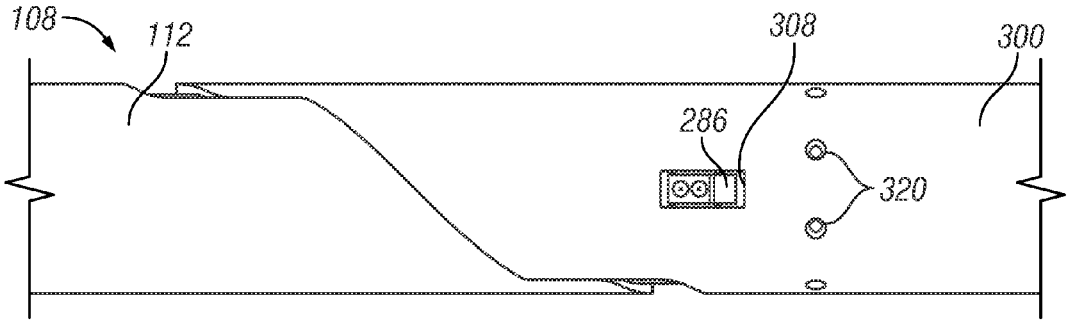
Figure 43:
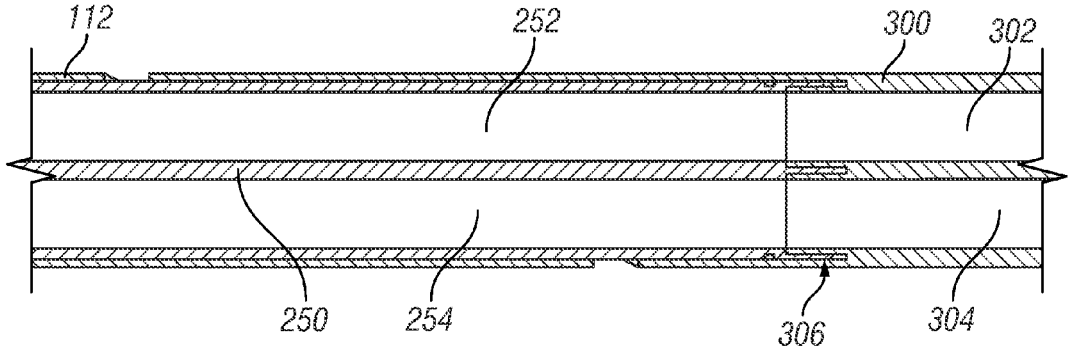

With reference to FIGS. 41-43, in some embodiments the diverter assembly 108 is coupled with a dual bore packer assembly 300 as is shown in the assembly of FIG. 5. The diverter assembly 108 is engaged with the packer 300 by latching the latch dog 286 of the latch assembly 280 into a latch receptacle 308 in the packer 300. As shown in FIG. 38, in this engaged and latched position, the outer surface of the latch dog 286 extends beyond the outer surface 269 of the diverter portion 250 and into the latch receptacle or hole 308. The end 266 of the diverter 108 is then locked with the packer 300. In some embodiments, the packer 300 includes holes 320 for bolting or shear screwing the packer into the diverter end 266. As shown in FIG. 43, the diverter portion 250 is joined with the packer 300 at a coupling 306 such that the flow bore 252 is aligned with a flow bore 302 of the packer 300, and the flow bore 254 is aligned with a flow bore 304 of the packer 300. It is also contemplated that other tools may be connected into the diverter assembly 108 instead of the packer 300.

Figure 44:
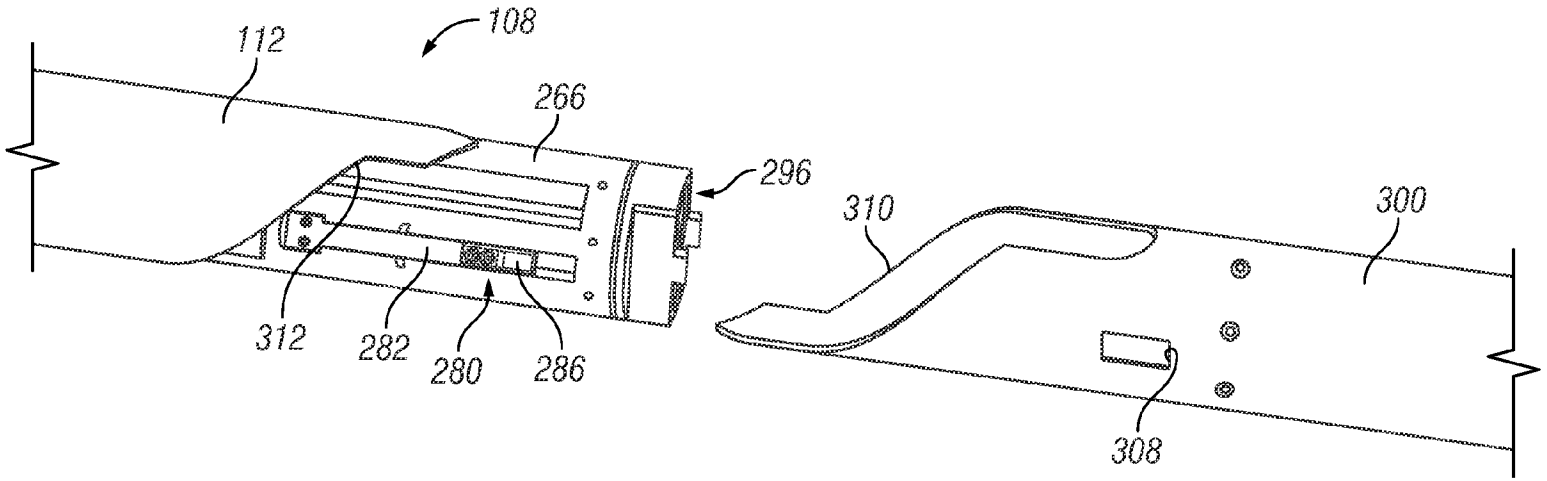
Figure 45:
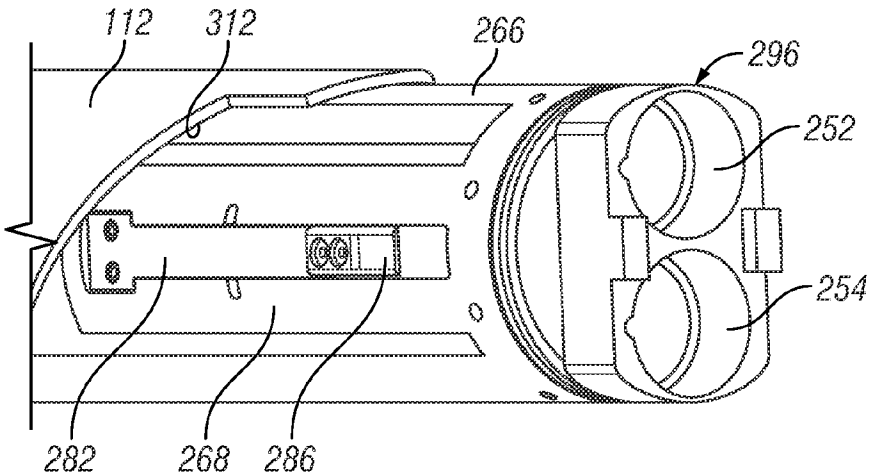
Figure 46:
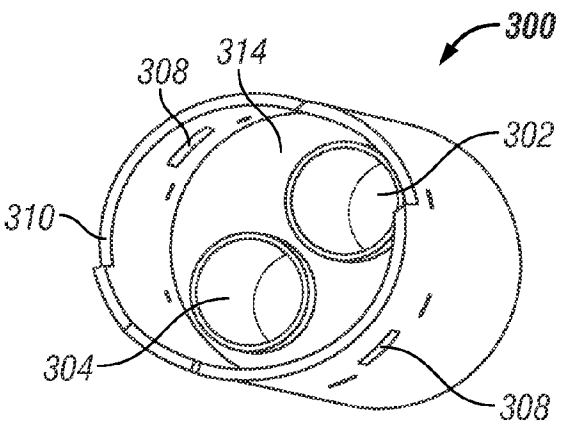
Figure 47:
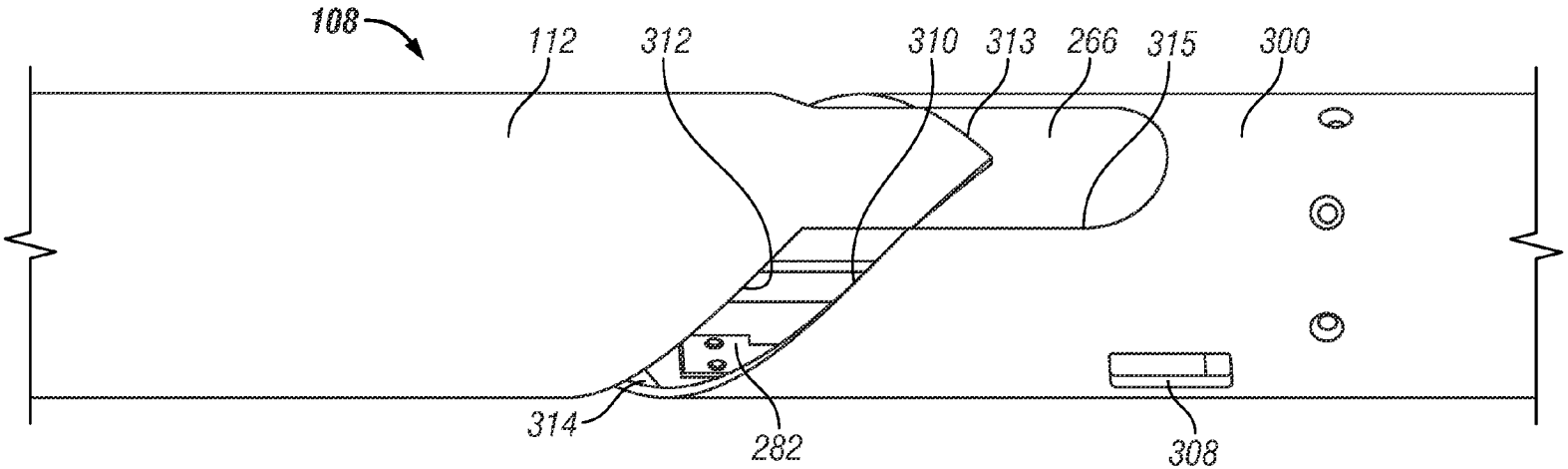
Figure 48:
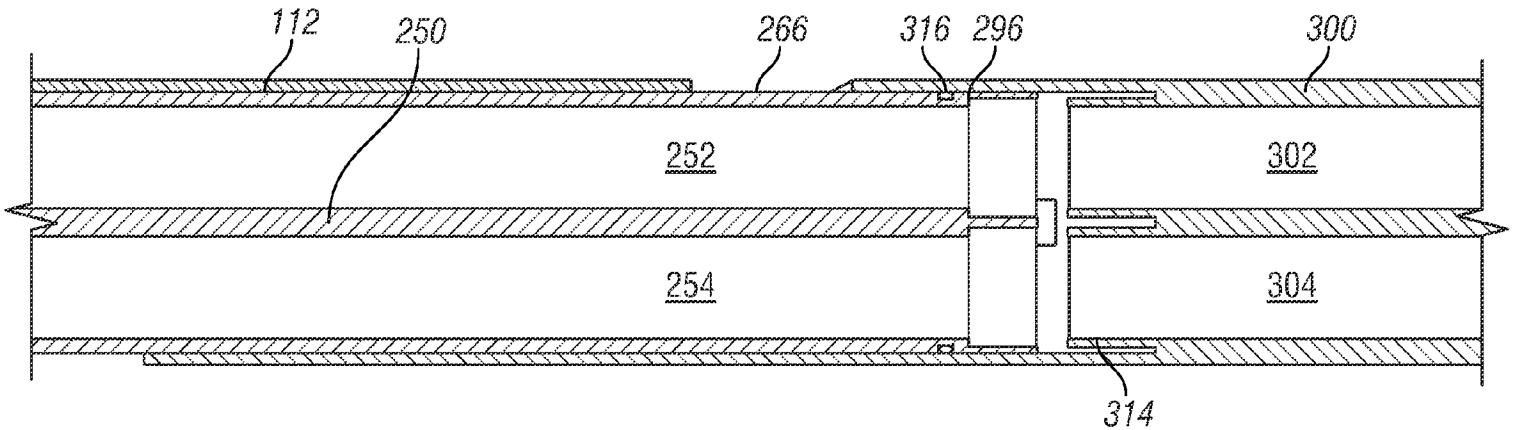
Figure 49:
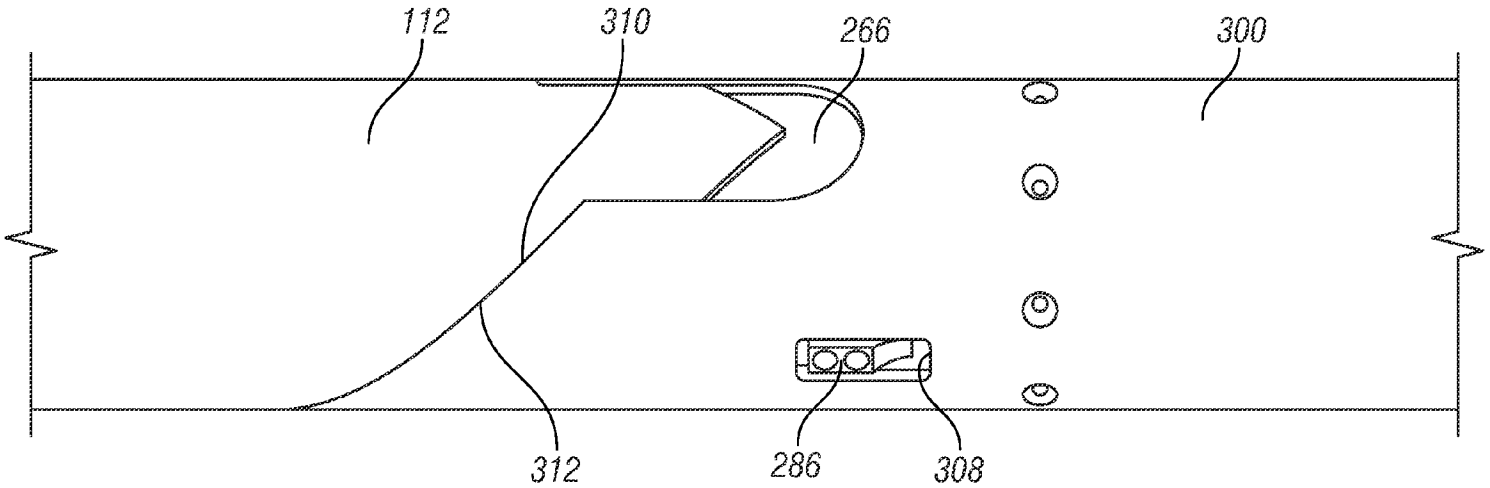
Figure 50:
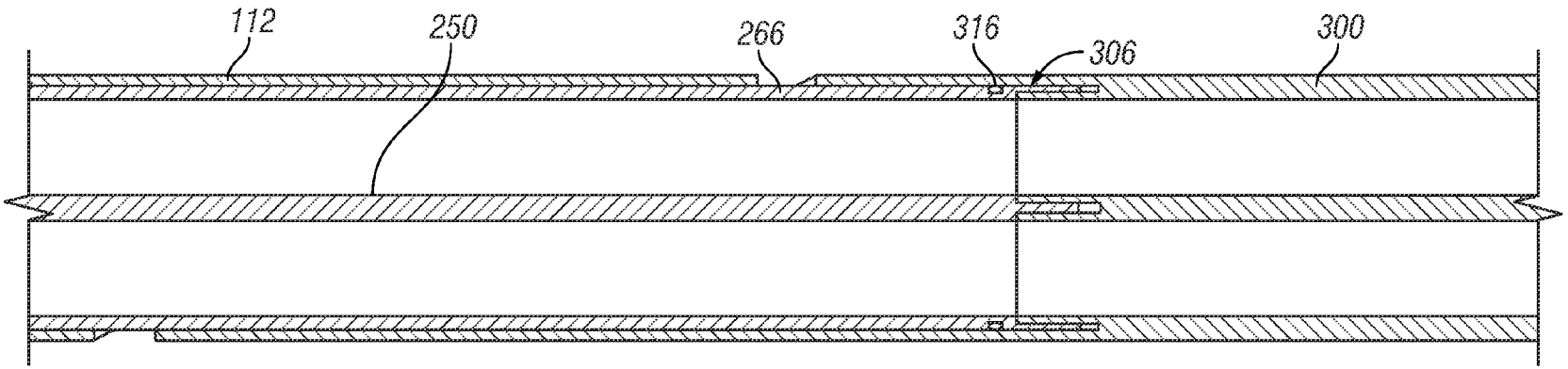

Referring to FIGS. 44-52, a new or re-worked diverter assembly 108 may be sent down hole to latch on to the top of the packer assembly 300. As shown in FIG. 44, the end 266 of the diverter 108 includes the latch dog assembly 280, the connector 296, and mule shoe profile 312 at the end of the diverter housing 112. The packer 300, which may already be positioned in the hole, includes an upper end having a mule shoe profile 310 designed to mate with the mule shoe profile 312. As shown in FIGS. 45 and 46, the connector 296 is received by and engaged with a receptacle 314 of the packer 300 in preparation for the connecting of the diverter 108 and the packer 300 and the alignment of the bores 252, 254 with the packer bores 302, 304. As shown in FIGS. 47 and 48, the connector 296 of the diverter end 266 is inserted into the receptacle 314 of the packer 300, and the lead guide surface 313 of the profile 312 engages the profile 310 and causes the diverter assembly 108 to rotate until the lead surface 313 is aligned with the slot 315 in the profile 310. The bore housing and connector 250 is designed such that the dual mule shoe alignment as just described will automatically align the latch dog assembly 280 with the receptacle 308, and the bores 252, 254 with the packer bores 302, 304. The diverter assembly 108 and the lead profile surface 313 will advance toward the packer 300 and the slot profile surface 315 until the position of FIGS. 49 and 50 is achieved.

Figure 51:
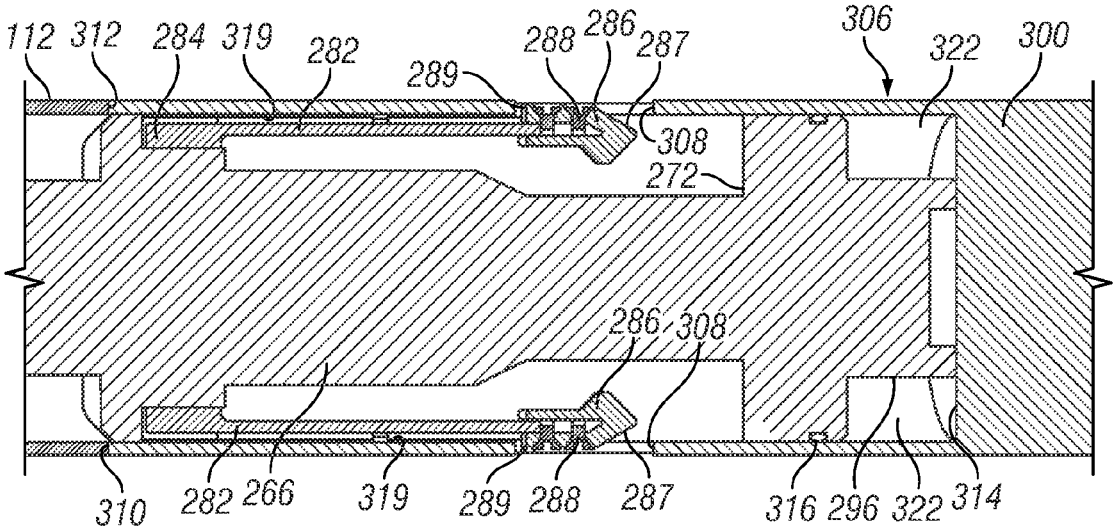
Figure 52:
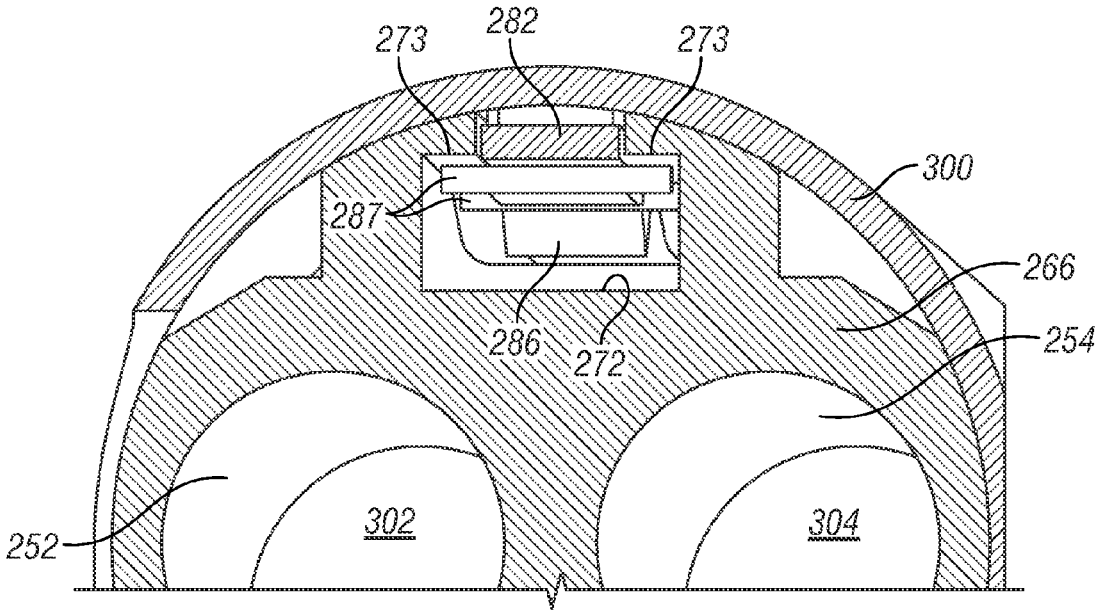

Referring to FIGS. 49 and 50, the latch dog 286, which was previously pressed radially inward by the inner surface of the receptacle 314 while the diverter 108 was advancing into the packer 300, has moved or snapped radially outward and into the receptacle 308. The mating profiles 310, 312 are fully engaged. The coupling 306 is formed between the diverter end 266 and the packer 300. An o-ring seal 316 aids in sealing the coupling 306. In FIG. 51, the latch dogs 286 are shown disposed in the receptacles 308. While the latch assembly 280 is advancing in the packer receptacle 314 to the position shown in FIG. 51, the lower angled surface 287 of the latch dog 287 presses against the inner surface 319 of the receptacle 314 and the flexible leaf spring 282 allows the latch dog 286 to move and remain inward of the surface 319 until latching occurs. The connector 296 is bottomed out in the receptacle 314 creating debris collection areas 322. An upper end 289 of the latch dog 286 resists upward movement of the diverter 108 against the receptacle 308. In some embodiments, if the diverter 108 is to be retrieved, enough upward force can be applied to the diverter 108 such that the force from the receptacle 308 onto the upper end 289 causes the shear screws 288 to shear and the latch dog 286 to decouple from the support member 282. This releases the diverter 108 from the packer 300. As shown in FIG. 52, the latch dog 286 includes the side projections 287 and the pocket 272 includes overhanging rails 273 to retain and capture the decoupled latch dog 286, thereby preventing debris from being left downhole upon decoupling of the diverter 108 from the packer 300.

Figure 53:
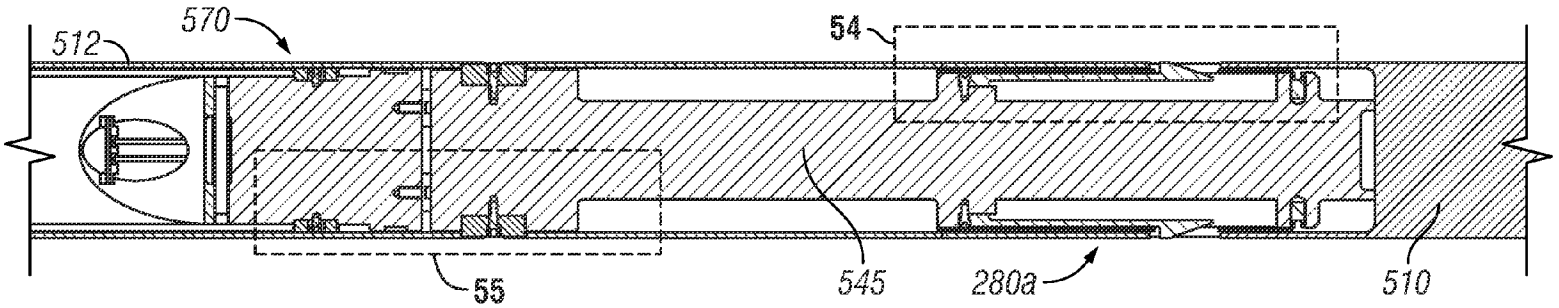
FIGS. 53-55 are longitudinal cross-section views of an alternative embodiment of the connector assembly latches and connection means.
Figure 54:
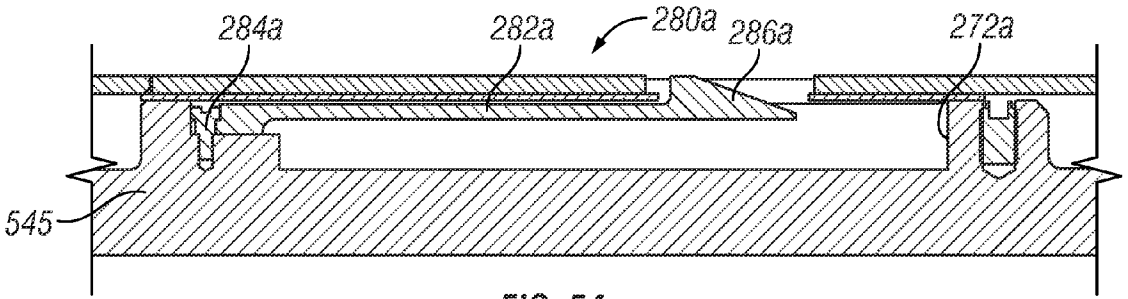
Figure 55:
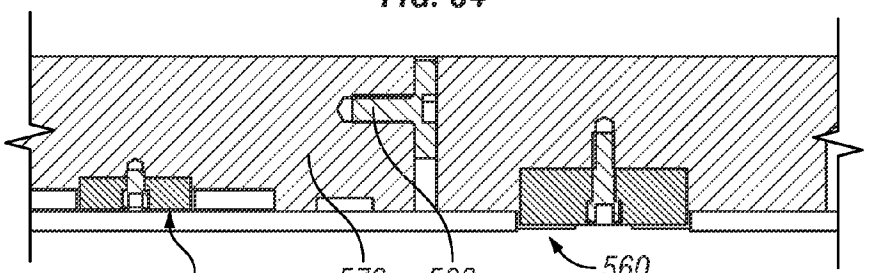

Referring to FIGS. 53-55, alternative embodiments of the latch dog assembly 280 and the connecting means for the lower connector 545 are shown. A latch dog assembly 280*a* includes a unitary support member 282*a* and angled shoulder 286*a* coupled to the connector body 545 by a shear screw 284*a*. Instead of only shearing the latch dog 286 as described above, the entire member 282*a*/286*a* is sheared away via shear screw 284*a*. The sheared member 284*a*/286*a* is released and captured in a pocket 272*a*. The connection means 560 couples the lower connector 545 to the housing 512, a connection means 561 couples to the diversion housing 570, and an impact screw 563 is coupled therebetween to receive the impact of repeated cycles of loading.

Figure 56:
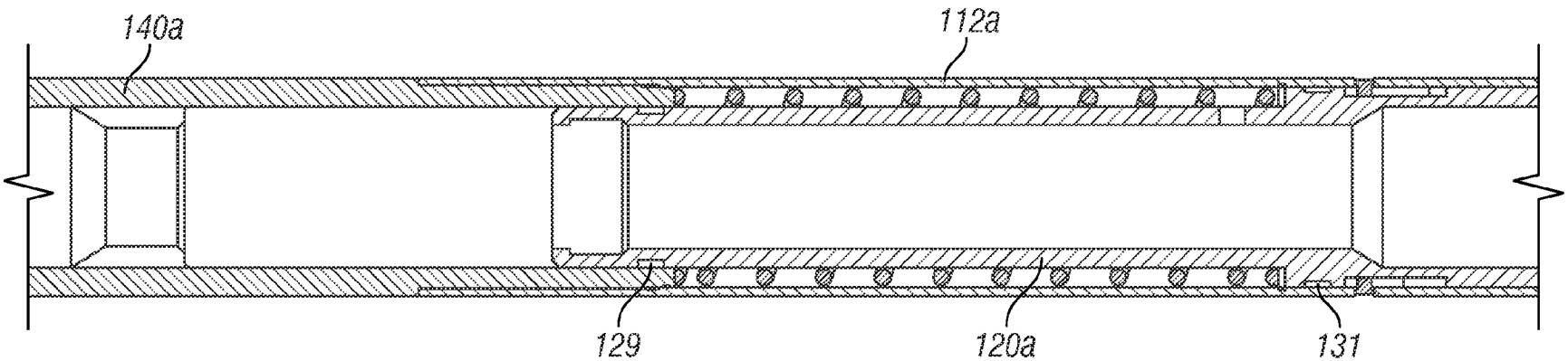
FIG. 56 is a longitudinal cross-section view of an alternative embodiment of the upper receptacle and mandrel assembly including bearing and/or debris removal rings.

Referring to FIG. 56, an alternative mandrel and upper receptacle assembly includes an upper receptacle 140*a* coupled to a mandrel 120*a* surrounded by a housing 112*a*. The mandrel 120*a* includes bearing and/or debris removal rings 129, 131.

Figure 57:
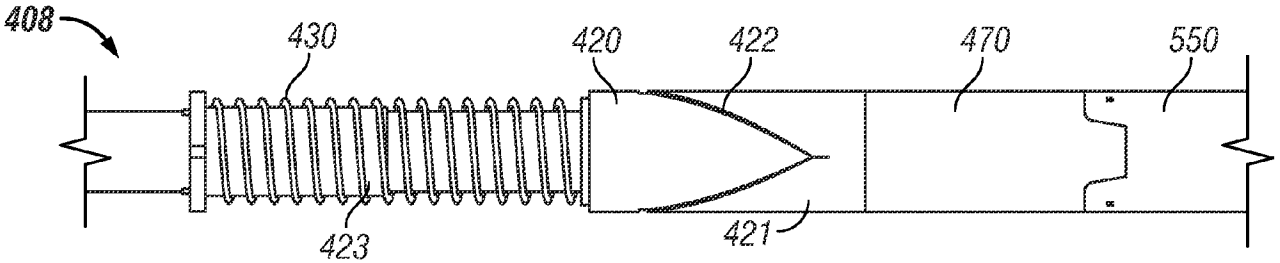
FIGS. 57-59 are various views of an alternative diverter assembly and actuation tool.
Figure 58:
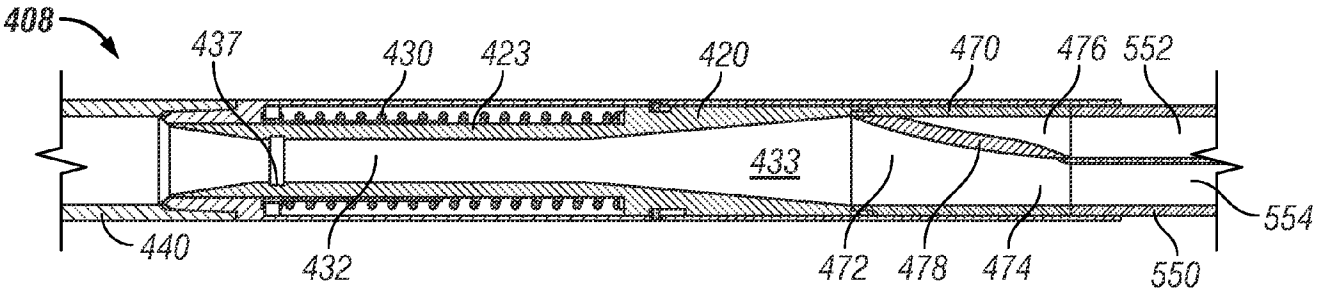
Figure 59:
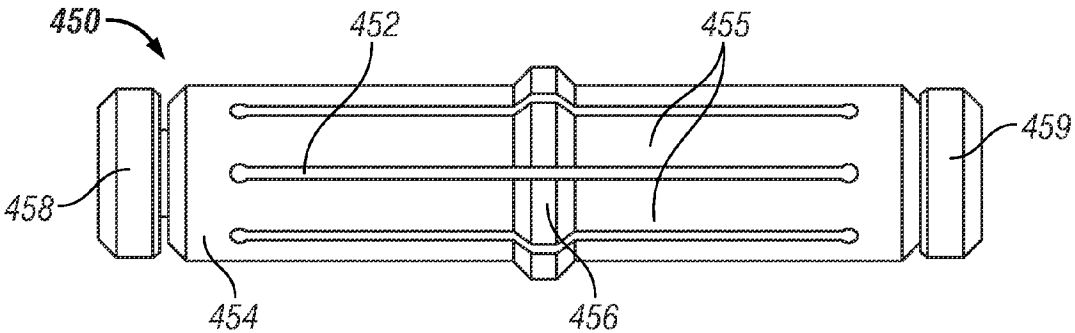
Figure 61:
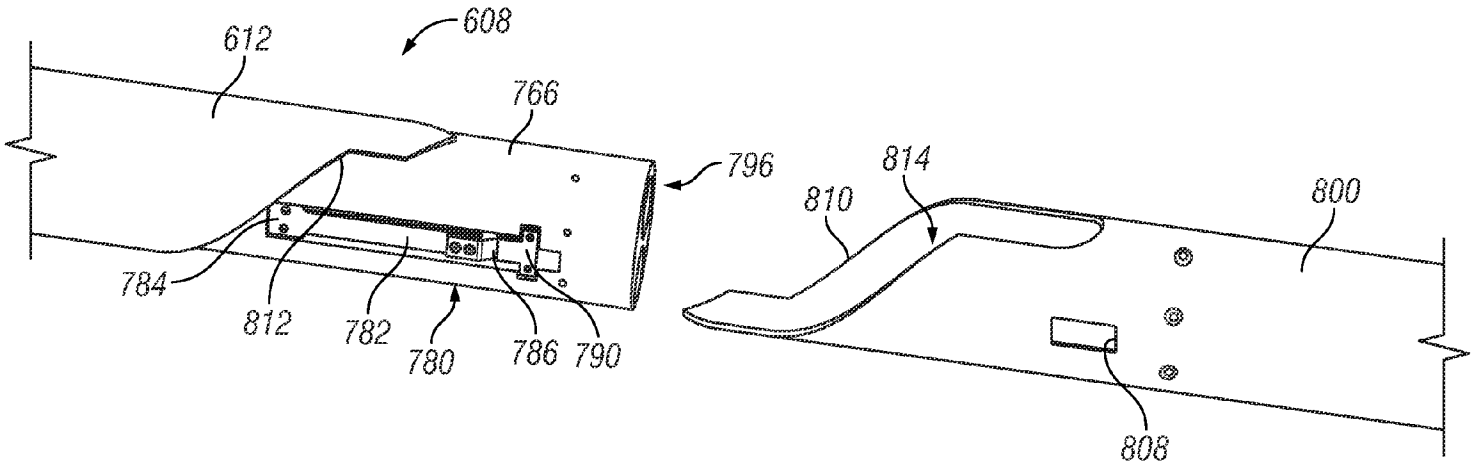
FIGS. 60-64 are various views of an alternative connection means and latching assembly between the diverter connector end and the lower packer assembly.
Figure 62:
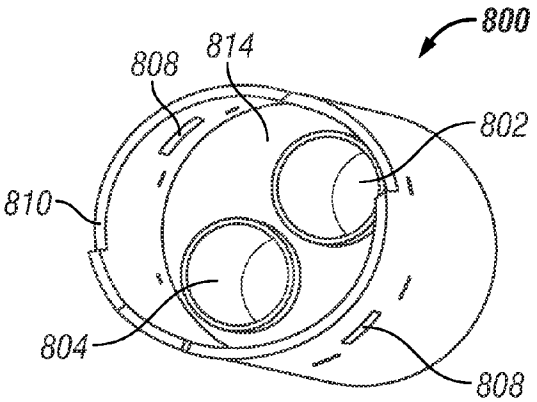

Referring to FIGS. 57-59, an alternative embodiment includes a diverter assembly 408, an upper coupling or receptacle housing 440 adapted to receive an operational or actuation tool 450, and a lower bore housing and connector 550. In FIG. 57, with the housing removed, the diverter 408 is shown to include a primary mandrel or cylindrical member 420 having a reduced diameter upper portion 423 and an increased diameter lower portion 421. Surrounding the portion 423 is a biasing spring 430. The outer surface of the portion 421 includes a guide groove or indexing slot 422 formed therein. A diversion housing 470 is coupled between the mandrel 420 and the lower bore housing 550.

Referring to the cross-section view of FIG. 58, the upper receptacle 440 is adapted to receive the actuation tool 450. The actuation tool 450 may be a wireline diverter operational tool. The actuation tool 450 includes an outer housing 454, as shown in FIG. 59, surrounding an inner member 452. The inner member 452 may be a tubular member having an upper connector 458 connectable to an upper tool. In some embodiments, the upper tool is a wireline tool. In some embodiments, the upper tool is a Welltec Tractor and Stroker tool run above the actuation tool 450. The inner member 452 also includes a lower connector 459 connectable to other tools run below the tool 450. The connector 459 may include an F-nipple plug for connecting to the lower tools. The outer housing 454 includes expandable and collapsible collets 455 having shoulders 456 for flexibly engaging a recess 437 in the upper end of the mandrel 420.

Referring again to FIG. 58, the diversion housing 470 is a dual fluid passage diversion housing including a primary upper passage 472 that is split into a lower first passage 474 and a lower second passage 476. A splitter or diverter 478 includes several reduced width members, shown elsewhere herein, that block passage of solid objects, such as the tool 450, into the second passage 476 while still allowing fluid flow therethrough. The housing 470 is coupled to the lower bore housing 550 such that a first flow bore or passage 552 is aligned with the first passage 474 and a second flow bore or passage 554 is aligned with the second passage 476.

Figure 60:
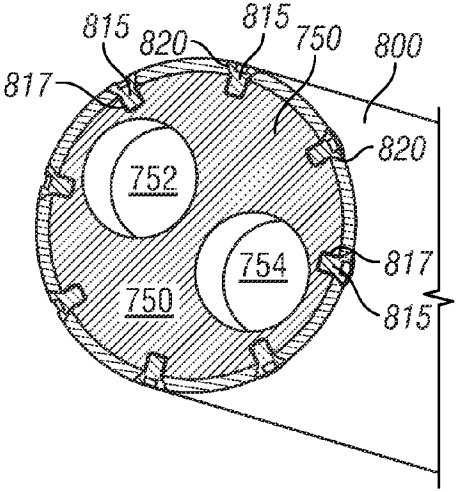

Referring to FIG. 60, in some embodiments a diverter connector end 750 with dual flow passages 752, 754 is coupled to a packer 800 by shear screws 815 screwed through holes 820 in the packer 800 and into bores 817 in the connector end 750 of a diverter 608.

Now referring to FIGS. 61-64, the characteristics of a latching end 766 of the diverter 608 and a receptacle end 814 of the packer 800 are similar to those described for diverter 108 and packer 300 with reference to FIGS. 44-46. However, a connector end 796 of the diverter 608 is configured differently from the connector 296 of diverter 108, as shown. Furthermore, the latch dog assembly 780 includes a coupled end 790 rather than the free end 290, but the leaf spring support member 782 still allows a latch dog 786 to flexibly move inwardly and outwardly to enter the packer receptacle 814 and latch outwardly into a receptacle 808.

Figure 63:
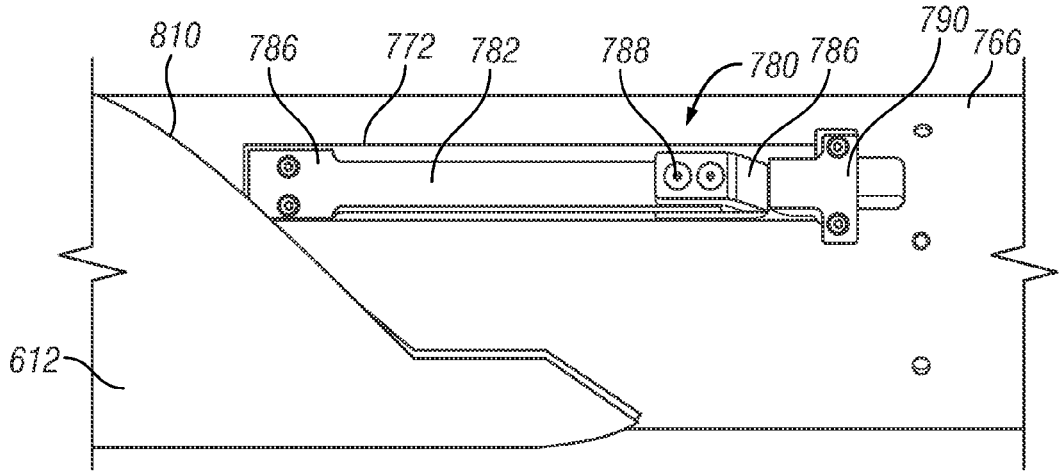
Figure 64:
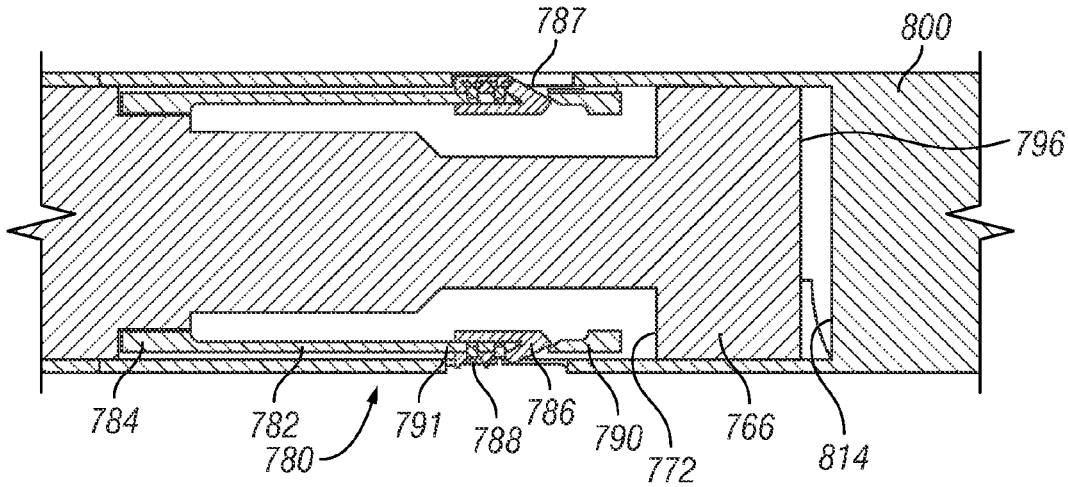
Figure 65:
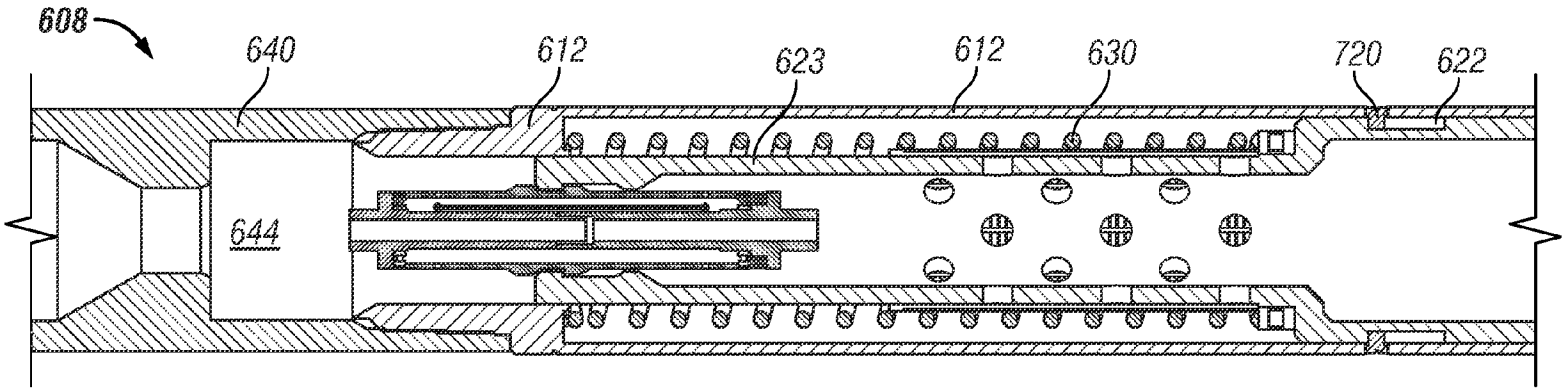
FIGS. 65-69 are various views of the upper portions of the alternative diverter assembly partially shown in FIGS. 60-64.
Figure 66:
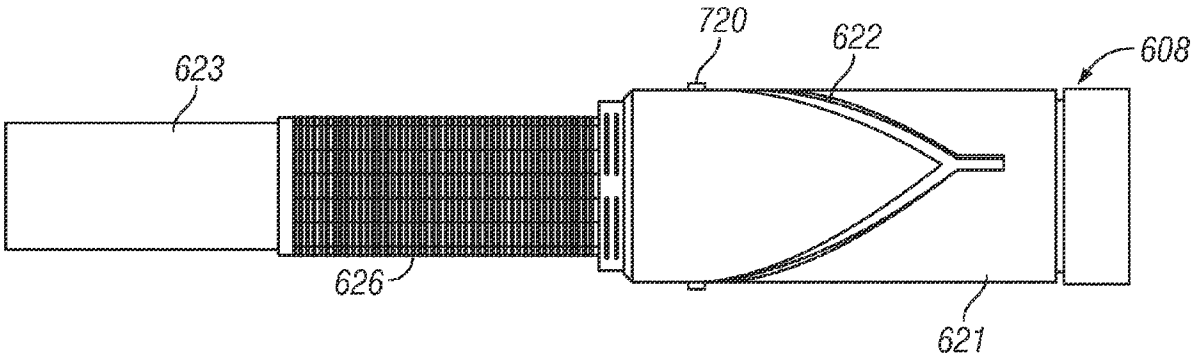
Figure 67:
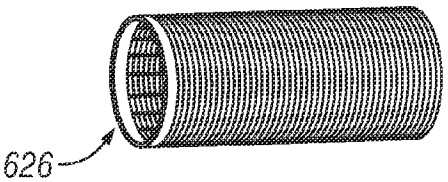
Figure 68:
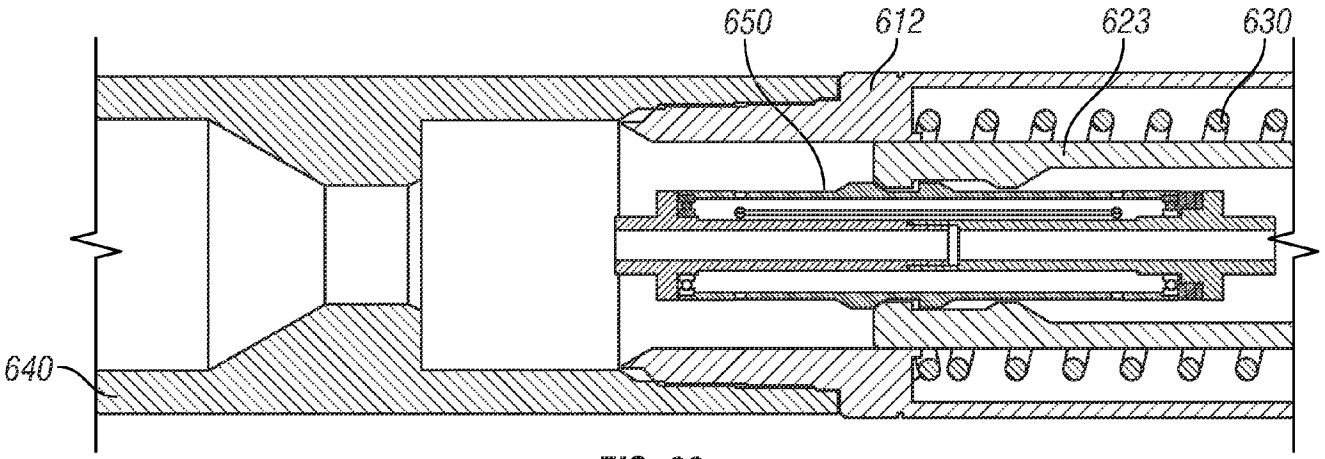
Figure 69:
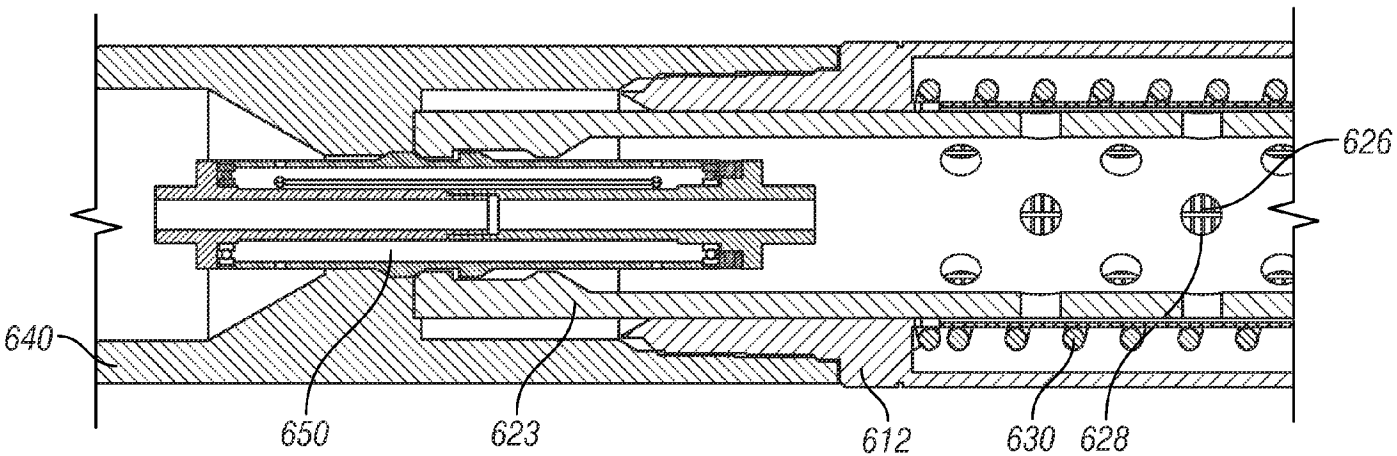

Referring now to FIGS. 63 and 64, some differences are noted over the latching shown in FIG. 51. The coupled end 790 serves to capture the free end 791 of the leaf support member 782 coupled with the latch dog 786. After the latch dog 786 is sheared away from the free end 791, as previously described, an angled surface 787 of the latch dog 786 guides the latch dog 786 along the capture member 790 and into the pocket 772 to retain the decoupled latch dog 786. The connector end 796 bottoms out in the receptacle 814 in a more flush manner.

Figure 73:
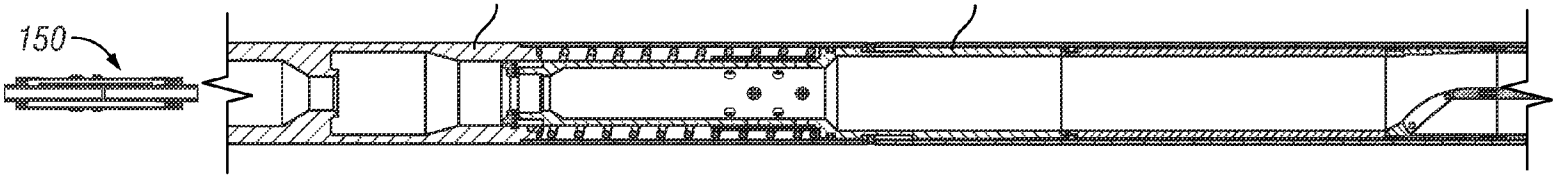
FIGS. 73-101 show various operational embodiments of the multiple bore diverter assemblies that are slidable and rotatable to alternately align multiple flow passages with the multiple bores of a lateral bore junction in accordance with the principles herein.
Figure 76:
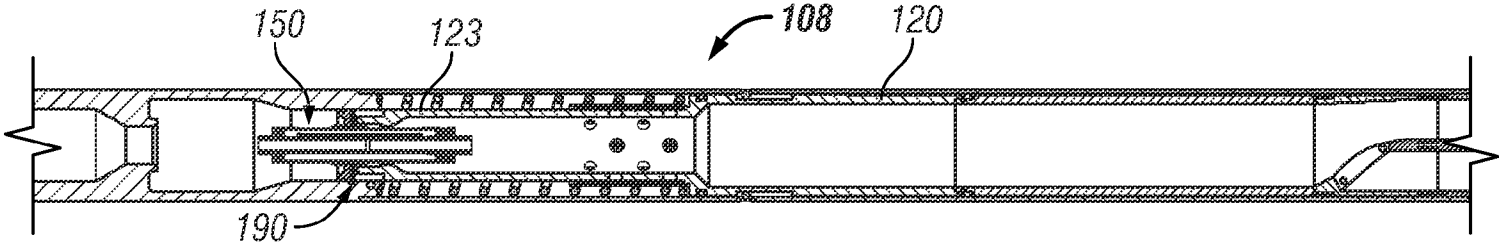
Figure 77:
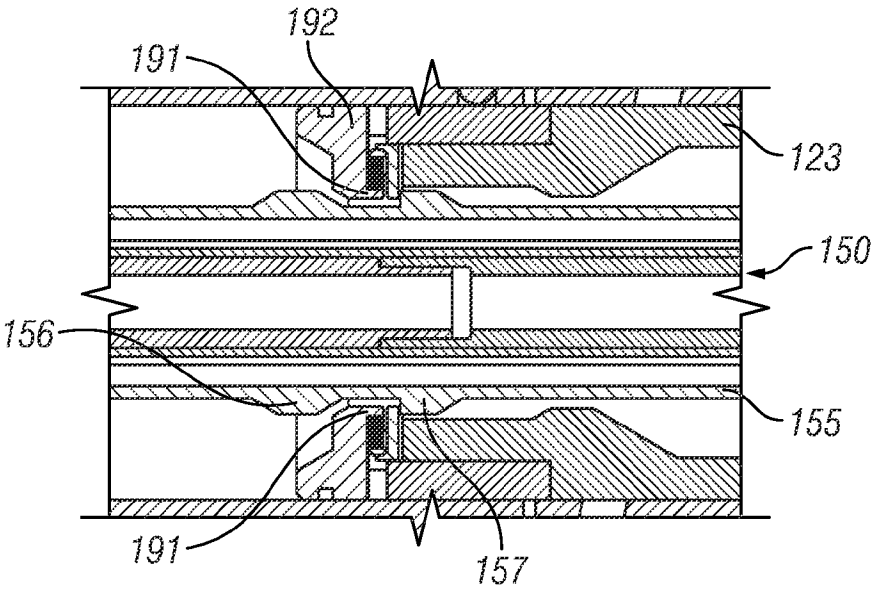

Referring to FIGS. 65-69, the characteristics of the diverter assembly 608 and its primary operational mandrel 620 are similar to those described for diverter 108 and mandrel 120. Some differences are noted. For example, the mandrel 620 does not include the upper mandrel locking assembly 190 shown in FIGS. 17-24. Furthermore, the mandrel portion 623 is slidably engaged with the upper portion of the outer housing 612, as shown in FIGS. 73, 76 and 77, while the mandrel portion 123 is slidably and lockably engaged with the upper receptacle 140 via the locking assembly 190. The sleeve 626 is shown apart from the mandrel in FIG. 67. Other features are also varied between the diverter 108 and the diverter 608.

Figure 70:
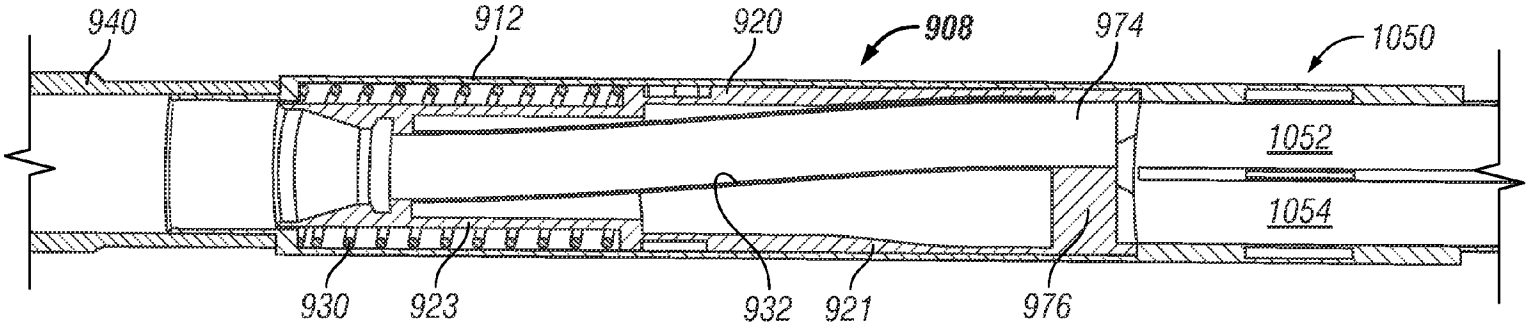
FIGS. 70-72 are various views of an alternative diverter assembly.
Figure 71:
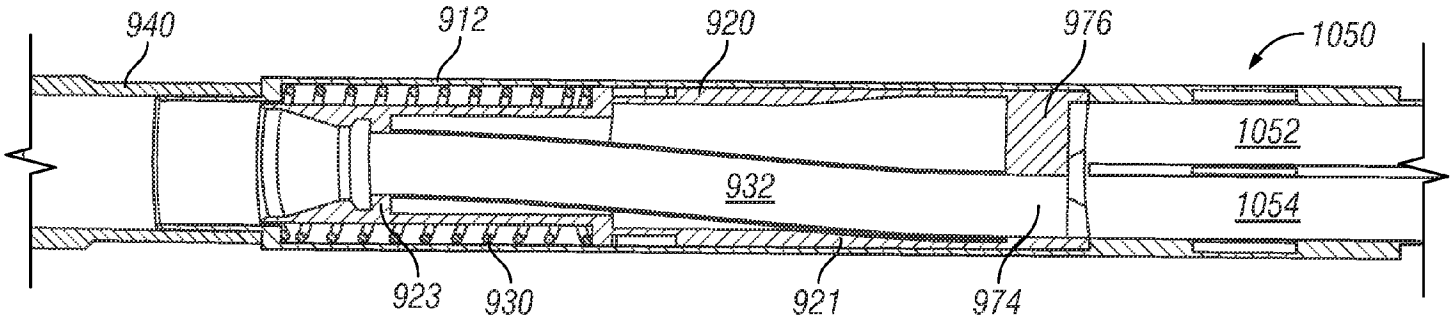
Figure 72:
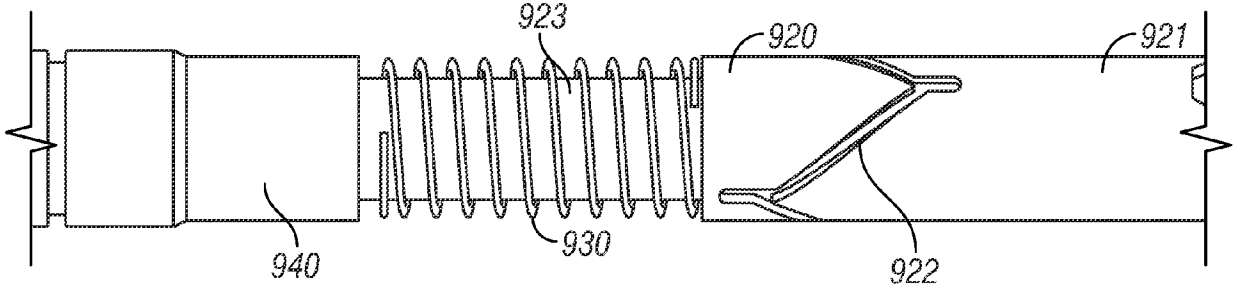

Another alternative embodiment of the diverter is shown as diverter assembly 908 in FIGS. 70-72. The diverter 908 includes an upper coupler 940, which may be coupled to or part of the packer 106 as shown in the tool arrangement of FIG. 4. An outer housing 912 contains the axially slidable and rotatable primary mandrel 920. An upper reduced portion 923 of the mandrel 920 includes a flow passage 932 therethrough and is surrounded by a biasing spring 930. A lower increased portion 921 of the mandrel 920 includes the diverted flow passage 932 to one side 974 of the mandrel 920. A blocker 976 is positioned opposite the open passage 974. A lower bore housing 1050 is coupled to the mandrel 920 and includes a first flow bore 1052 (shown aligned with the open passage 974) and a second flow bore 1054 (shown aligned with the blocker 976). The mandrel 920 is rotatable to re-align the open passage 974 with the second flow bore 1054 and block the first flow bore 1052 with the blocker 976. In some embodiments, the blocker 976 includes apertures that allow fluid passage but not the passage of solid objects. To aid the rotatable alignment of the mandrel 920, the biasing spring 930 axially biases the mandrel 920 while a multi-cycle J-groove or indexing slot 922 forces rotation of the mandrel 920 when axial forces are applied that overcome the biasing force of the spring 930.

Figure 74:
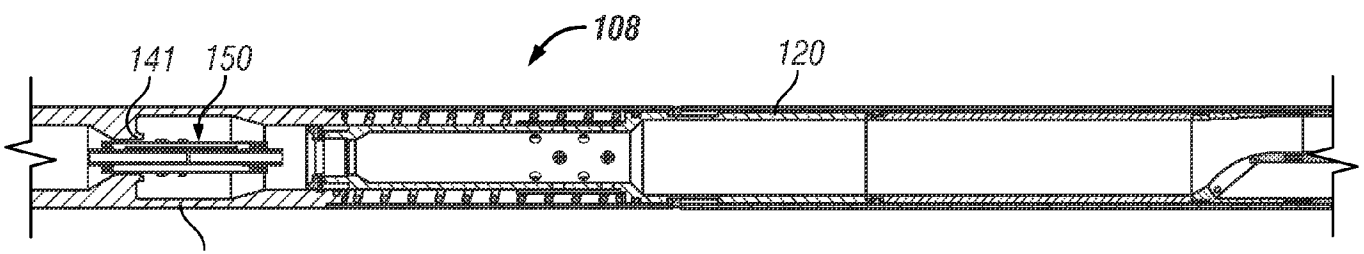
Figure 75:
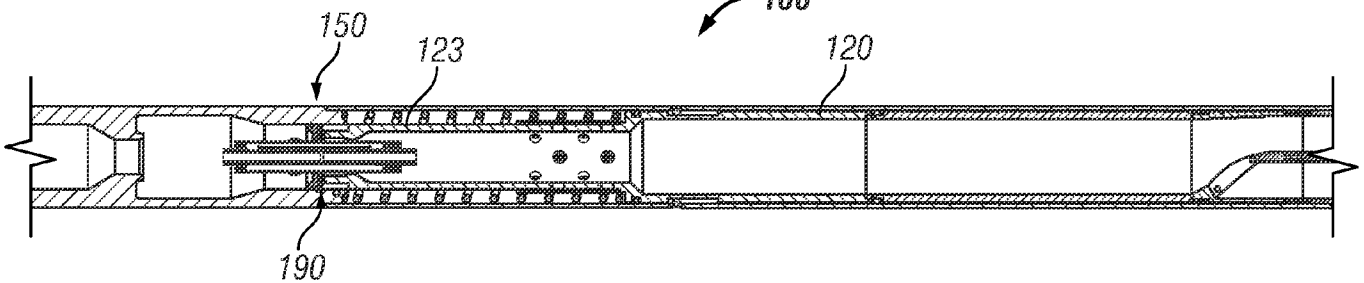
Figure 78:
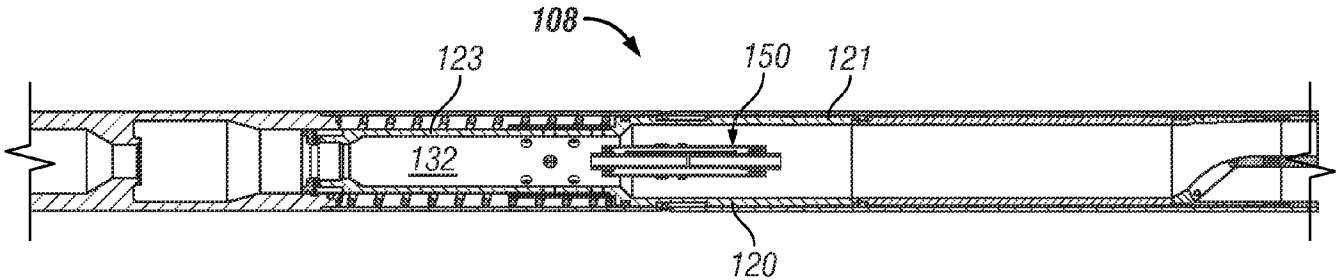

In operation, and with reference to FIGS. 73-101, the wireline operational tool 150 is lowered into the main borehole to a position just above the diverter 108 as shown in FIG. 73. The tool 150 enters the upper receptacle 140 and passes a restriction or shoulder 141 as shown in FIG. 74. In FIG. 75, the tool 150 passes into the upper mandrel portion 123 and the locking assembly 190. The collets 155 on the tool 150 begin to compress because the shoulders 157 are forced against the reduced diameter shoulder 191 (FIG. 17), or nipple, of the locking assembly 190. As shown in FIGS. 76 and 77, the tool 150 has landed in the diverter nipple 191 once the flexible collets 155 have allowed the shoulders 157 to flex inward and pass the nipple 191. The diverter nipple 191 is disposed between the tool shoulders 156, 157. As shown in FIG. 78, the continued downward movement of the tool 150 causes the upper shoulders 156 to compress against the diverter nipple 191 and the collets again compress to allow the tool to pass through the diverter nipple 191 and fully into the central mandrel flow passage 132.

Figure 79:
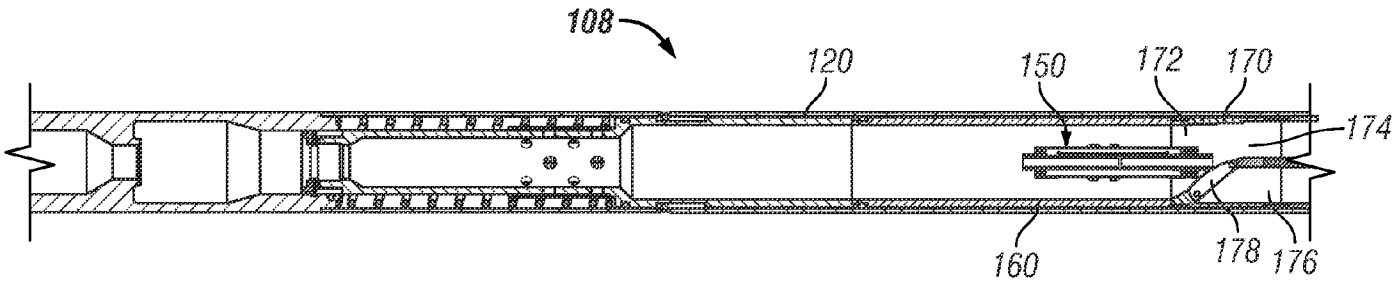
Figure 80:
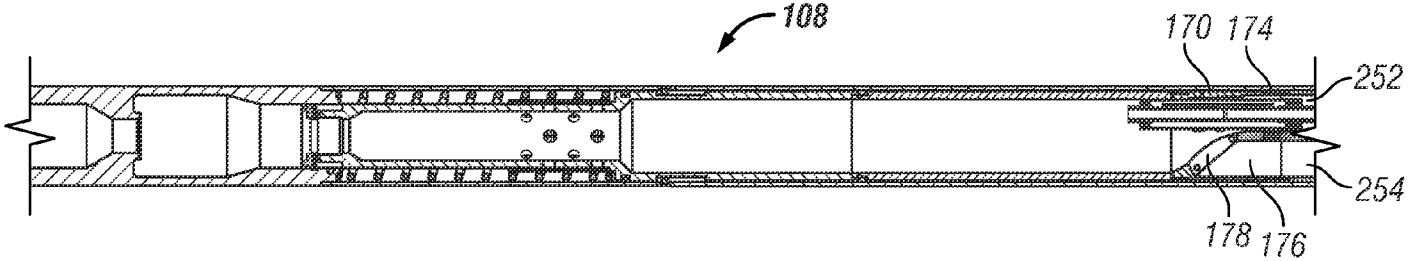
Figure 81:
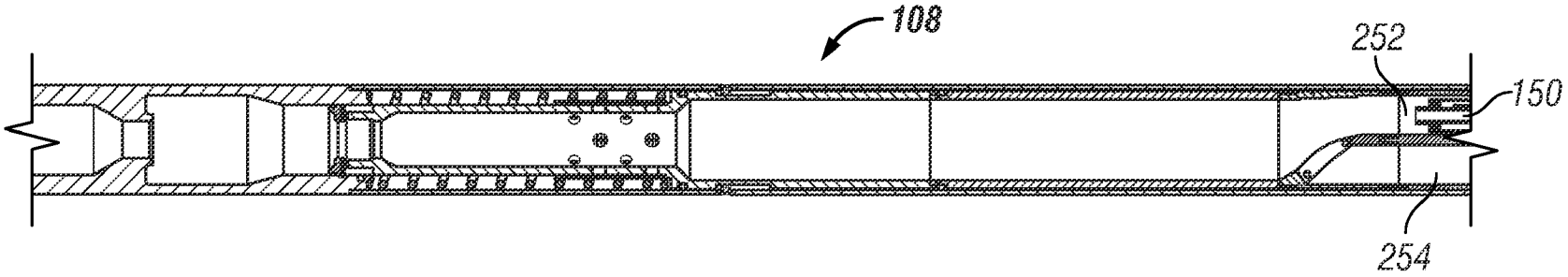

Referring to FIG. 79, the wireline string tool 150 is navigating the bend in the diverter 108, embodied in the diversion housing 170. The tool 150 enters the primary flow passage 172 and engages the diverter 178, which then directs the tool 150 into the first flow passage 174. Entry into the second flow passage 176 is blocked. The tool 150 then enters the flow passage 174 (FIG. 80), which in some embodiments is aligned with the lateral bore 40 and the tubing therein as described herein. The wireline tool 150, attached to a wireline work string or other operational string, continues into the flow bore 252 and down to the lateral bore 40 as shown in FIG. 81. In some embodiments, the tool 150 and the wireline attached thereto perform intervention work down hole with other tools in the wireline tool string. Other operations are also contemplated with the tool 150 that has passed through the diverter 108 and to downhole equipment in the lateral bore 40.

Figure 82:
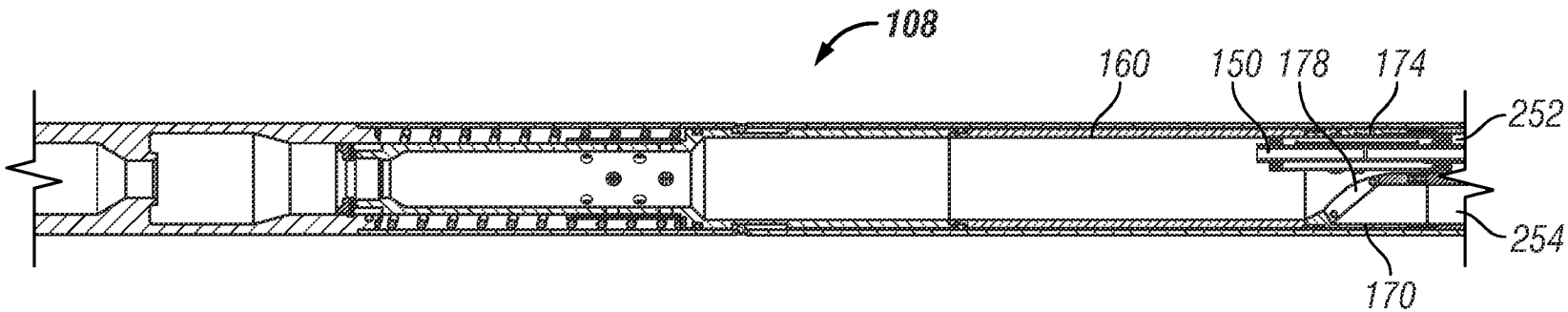
Figure 83:
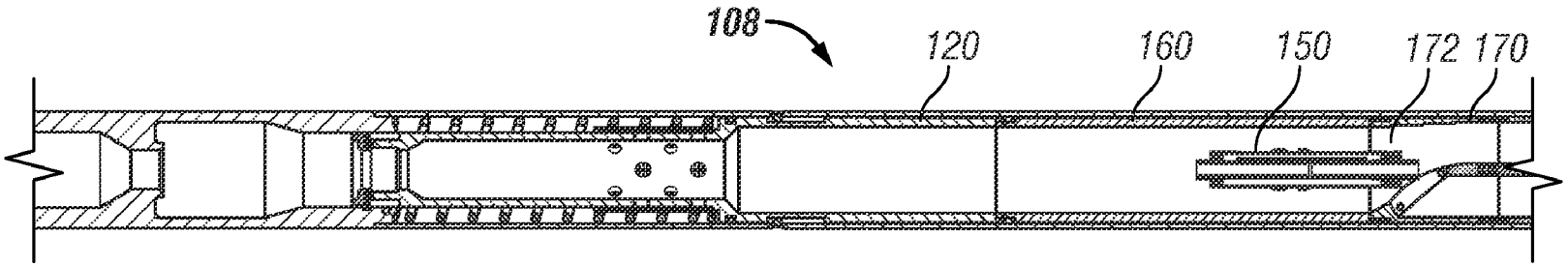
Figure 84:
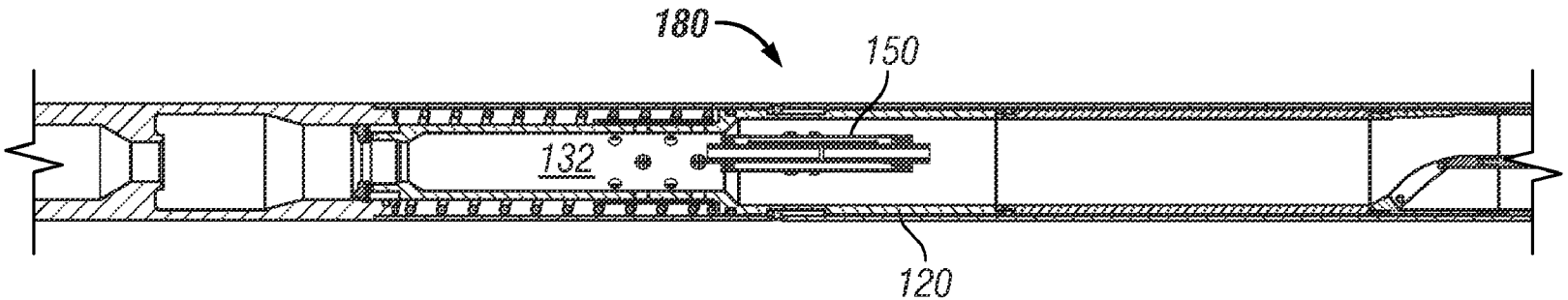
Figure 85:
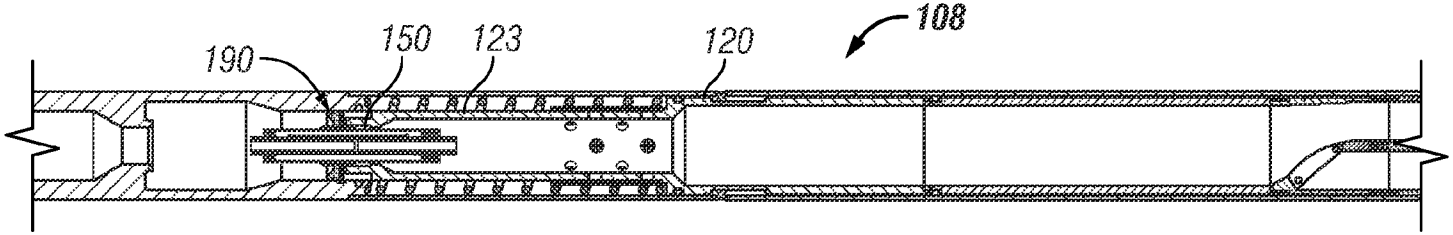
Figure 86:
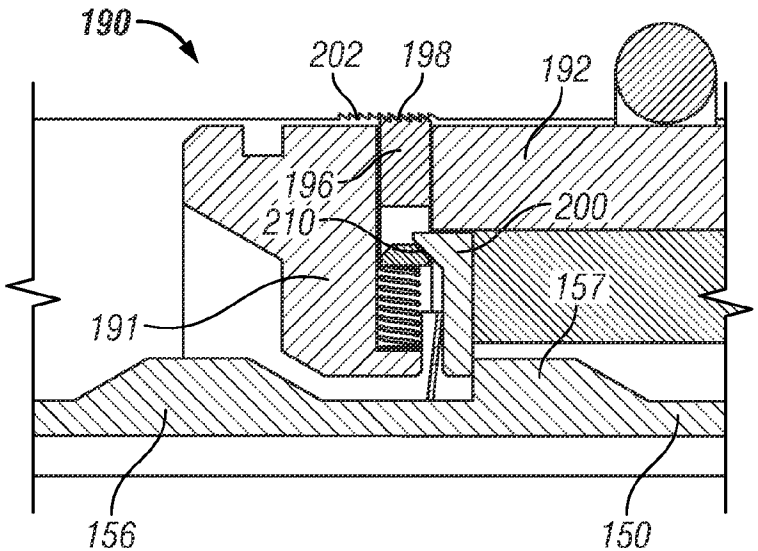
Figure 87:
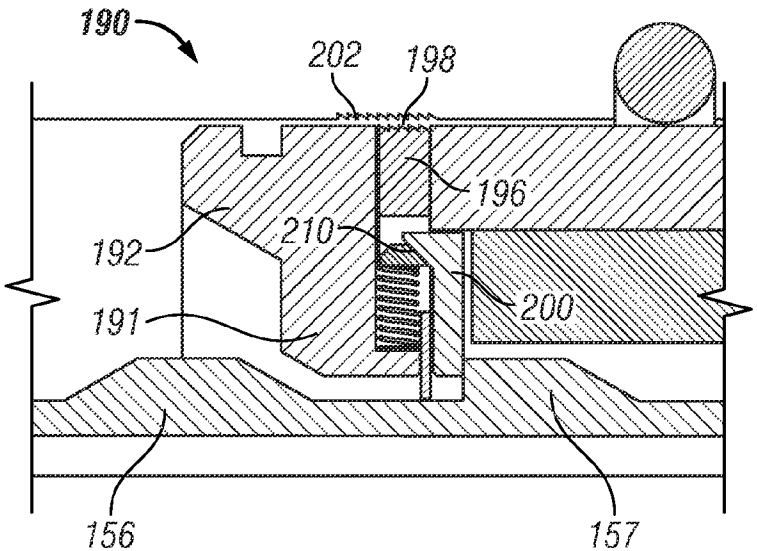

Referring to FIG. 82, the tool 150 exits the lateral bore 40 after the intervention work is complete. The tool is now repositioned in the flow passage 174 of the diversion housing 170 from the flow bore 252. In FIG. 83, the tool 150 has exited the lateral bore 40 and back into the primary passage 172 aligned with the tubular 160 and the mandrel 120. In FIG. 84, the tool 150 continues to be pulled upward and into the passage 132 of the mandrel 120. In FIG. 85, the tool 150 has landed back into the nipple 191 by compressing the collets as described, this time first with shoulders 156. In a first position, as shown in FIG. 86, the locking assembly 190 is locked with the teeth 198 of the locking member 196 engaged with the teeth 202. Upward force exerted by the shoulder 157 on the locking ring 200 slides the surface 210 on the member 196 and pulls the member 196 radially inward. This action disengages the teeth 198 from the teeth 202 and provides an unlocked position of the diverter system 108 as shown in FIG. 87.

Figure 88:
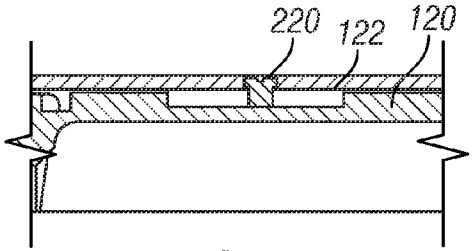
Figure 89:
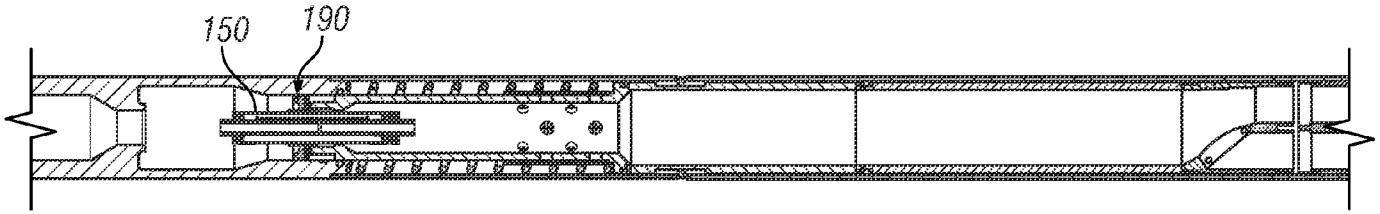
Figure 90:
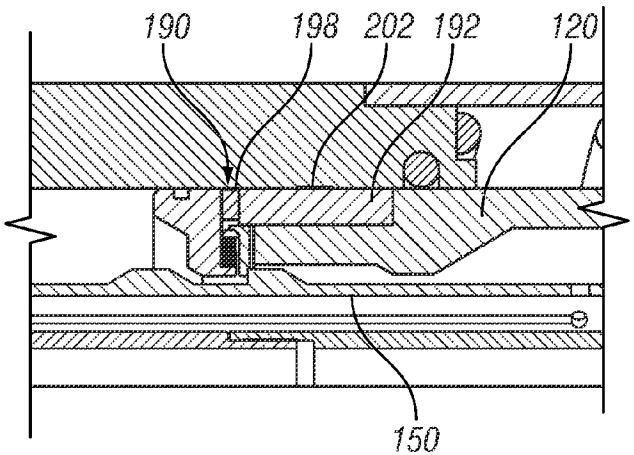
Figure 91:
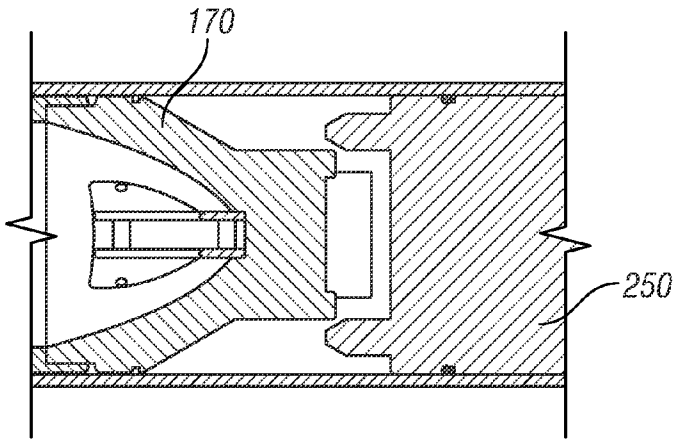
Figure 92:
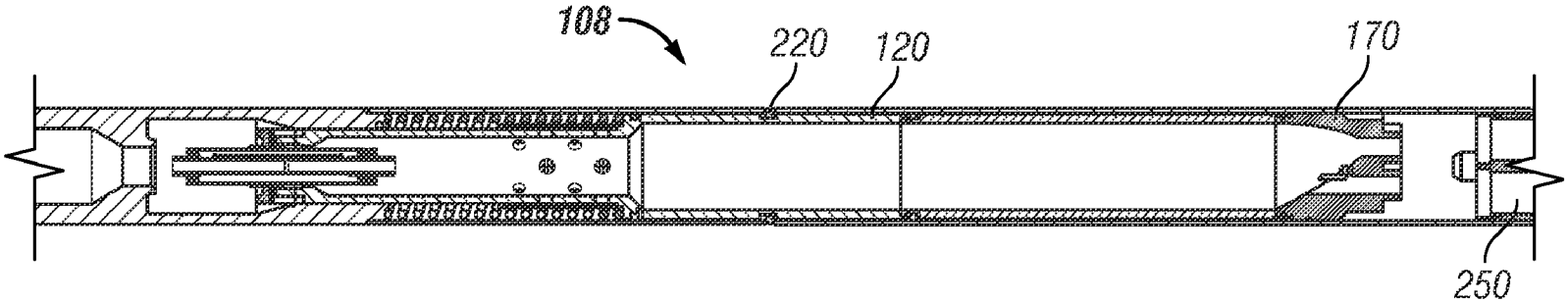
Figure 93:
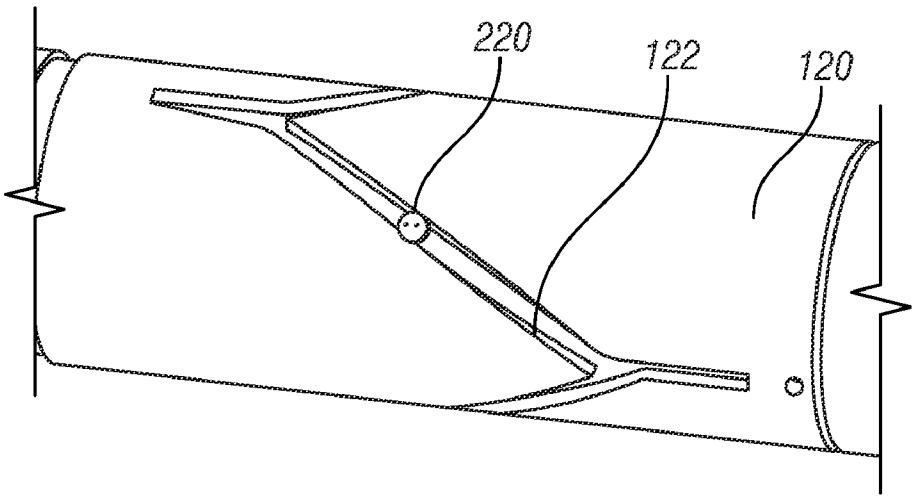
Figure 94:
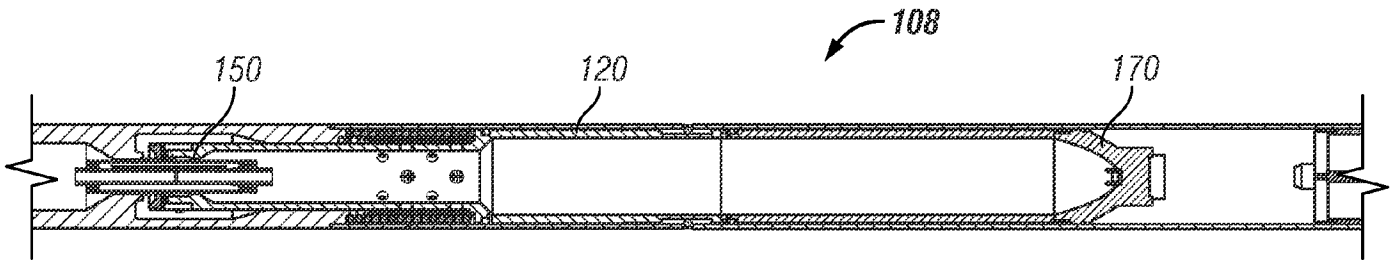
Figure 95:
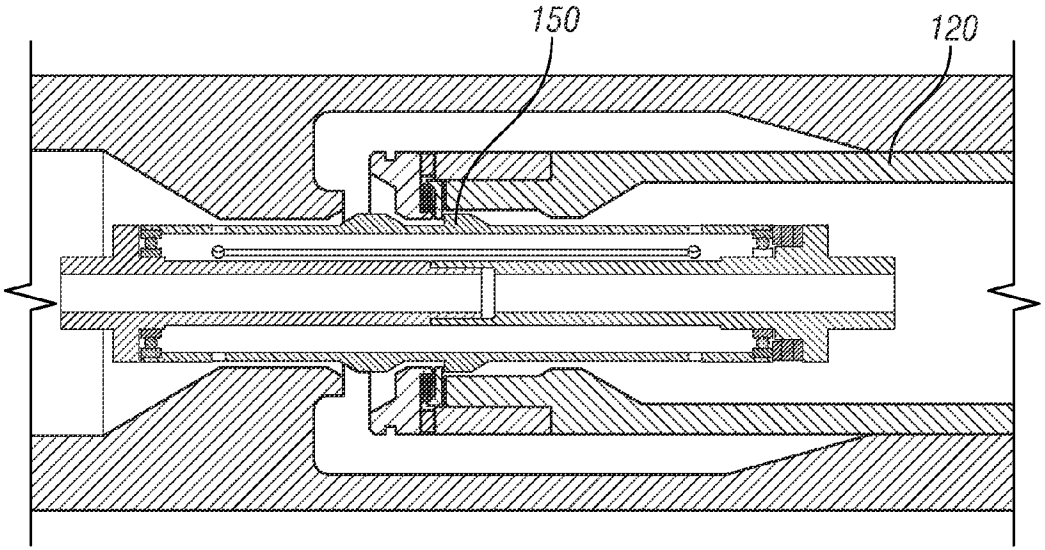
Figure 96:
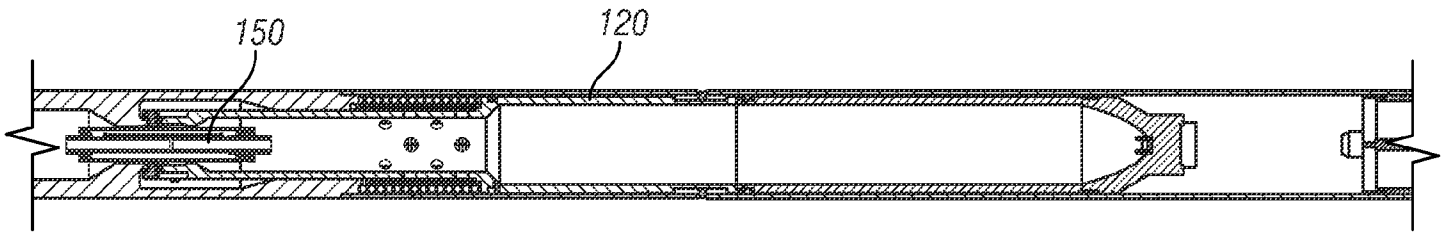
Figure 97:
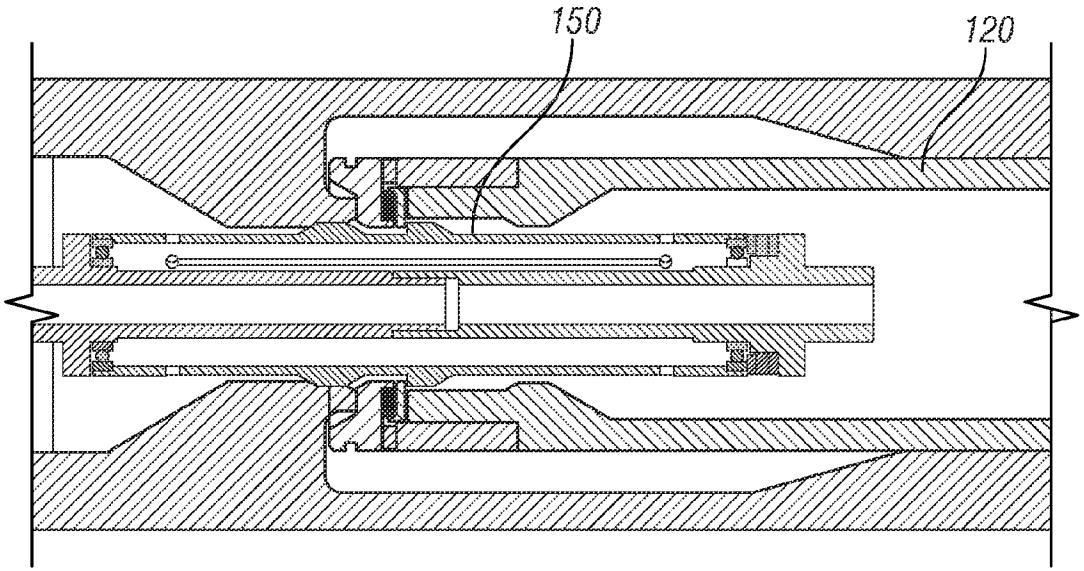

In FIGS. 88-98, the tool 150 is used to rotatably cycle the diverter 108 using the indexing features described herein. In FIGS. 88 and 89, the tool 150 captured in the locking assembly 190 is stroked upward. The lug 220 in the indexing slot 122 is guided through the indexing slot 122 to cycle the mandrel 120 through its rotating positions. FIG. 90 shows the upward movement of the mandrel 120 and the locking assembly 190. The mandrel 120 and the components coupled thereto index to the next stop position, and the features between the diversion housing 170 and the bore housing 250 aid in alignment at the bottom of the diverter 108 after rotation and axial movement back downward, as shown in FIG. 91. In FIGS. 92 and 93, the tool 108 is in mid-stroke as represented by the guide pin 220 being positioned in the angled slot between stop positions of the indexing slot 122. The diverter 108 has rotated 45 degrees at this point, and the diversion housing 170 is shown separated from the housing 250 due to axial movement of the diverter 108. In FIG. 94, the tool 150 and diverter 108 continue to be stroked upward, and the diverter 108 has been cycled 90 degrees at this point. In FIG. 95, the tool 150 is nearing its release point. If upward force is continued, the tool will release away from the diverter 108. The diverter 108 will cycle back down via the compression spring. Continued stroking of the tool upward to an internal stop position of the indexing slot 122 will cycle the diverter 108 90 degrees, as shown in FIG. 96. The tool 150 will release and the diverter will cycle back due to the biasing force of the spring 130.

Figure 98:
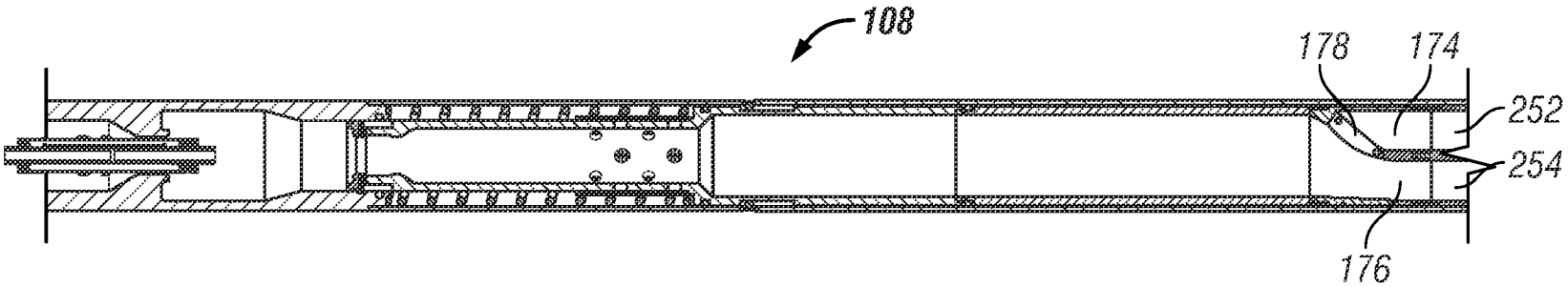
Figure 99:
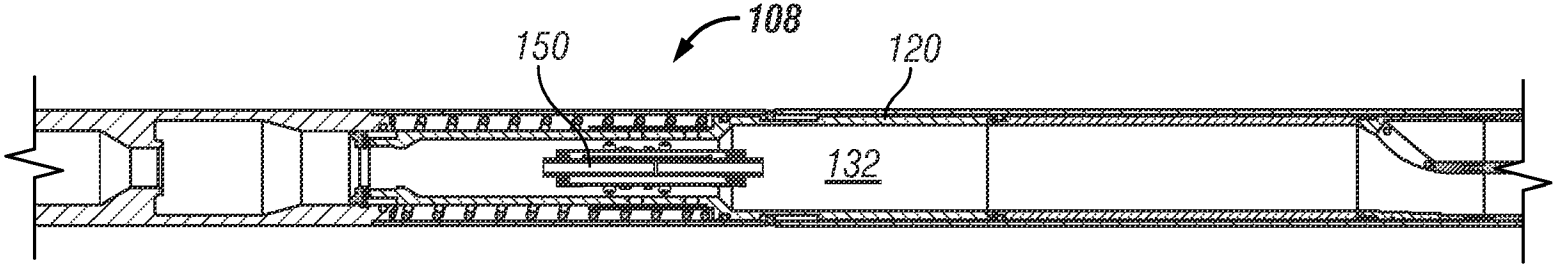
Figure 100:
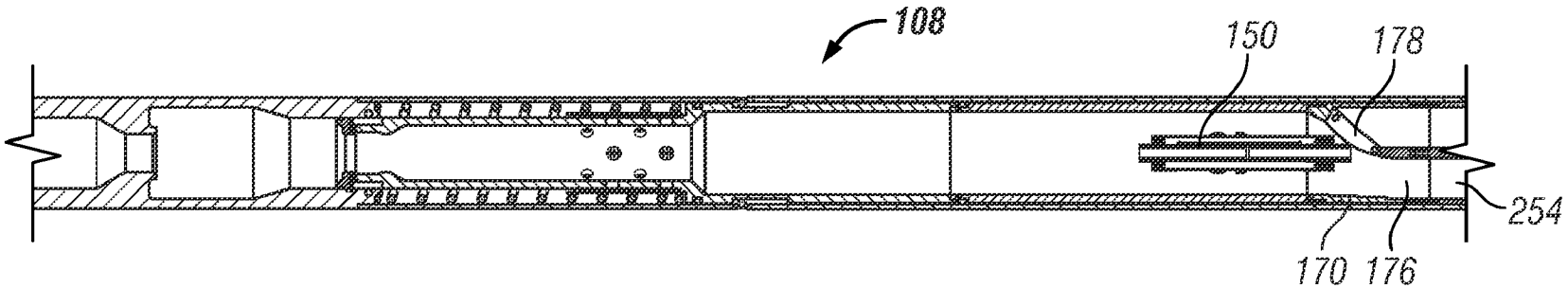
Figure 101:
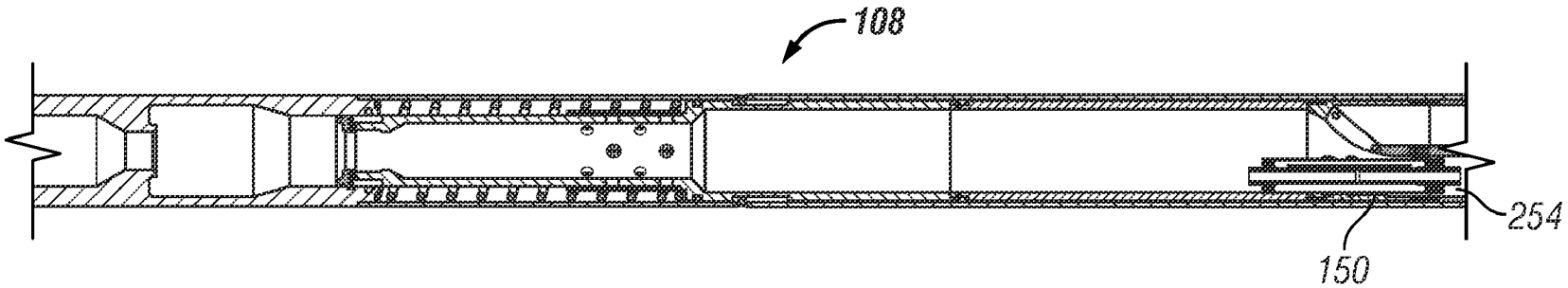

With the tool 150 released from the diverter 108 as shown in FIG. 98, the diverter will stroke downward and rotate the remaining 90 degrees to another stop position associated with another stop position of the indexing slot 122. The diverter 108 will now be positioned for entry into the main borehole 30, as is shown in FIG. 98 wherein the passage 176 is now aligned with the flow bore 254. Now, the tool 150 may re-enter the diverter 108 as shown in FIG. 99. The tool 150 again navigates the bend in the diverter at the diversion housing 170, this time being routed by the diverter 178 to the passage 176, 254 of the main borehole as shown in FIG. 100. The wireline string of the tool 150 now enters the main bore in FIG. 101. The wireline and tool 150 continue down the main bore to perform intervention work down hole with other tools in the wireline tool string. The wireline string and tool 150 may then be pulled to exit the main bore after intervention work is complete. The wireline and tool 150 re-enter the mandrel 120, and the tool 150 is landed back into the diverter nipple 191. The wireline string and tool 150 can then be stroked upward to remove the tool 150 from the diverter 108. Once the tool 150 stops, the profile will compress the collets and remove the tool 150 from the diverter 108. The tool 150 exits the diverter back to the surface. The spring 130 in the diverter 108 will cycle the diverter assembly to the opposite bore after the tool 150 exits the diverter.

Thus, as outlined in detail above, the several embodiments of the diverter assembly can be selectively actuated to direct a tool or tubing through-passage toward a desired borehole. The primary tool through-passage of the diverter assembly can be alternately and continually aligned and re-aligned with a desired borehole out of multiple boreholes, while the diverter assembly remains in the well. After a single trip into the well, and placement of the diverter assembly in the well junction, the diverter assembly can be actuated to rotate flow passages into alignment with multiple boreholes. In certain embodiments, an actuation tool is lowered into the diverter assembly and manipulated to activate a mandrel. The mandrel is guided by an indexing mechanism to rotatably cycle through discrete and predetermined alignment positions that correspond generally with the stop positions of a guide pin in a guide slot of the indexing mechanism. The actuation tool is continually raised and lowered to selectively rotate the mandrel and indexing mechanism and thereby alternately align the flow passages of a diversion housing with selected boreholes.

The mandrel may include a locking assembly for securing and releasing the mandrel relative to the housing or upper receptacle of the diverter assembly. A lower connector of the diverter assembly may include a releasable latching assembly for connecting the diverter assembly into a packer or other installed downhole device and then releasing the diverter therefrom. In one aspect of the assembly, the lower connector and the upper receptacle form a chamber with the outer housing. The mandrel and diversion housing assembly is captured in the chamber and slidable between the lower connector and upper receptacle, while also being rotatable by the indexing mechanism to achieve selective alignment of the diversion housing passages with the bores below.

While specific embodiments have been shown and described, modifications can be made by one skilled in the art without departing from the spirit or teaching of these principles. The embodiments as described are exemplary only and are not limiting.

What is claimed is:

1. A rotary diverter assembly for selectively aligning with multiple boreholes comprising:

an outer housing;

a mandrel slidably and rotatably disposed in the outer housing, the mandrel including a diversion housing having separate and pre-defined adjacently disposed first and second passages; and an indexing mechanism disposed between the mandrel and the outer housing to rotatably align the each of the first and second passages of the diversion housing with the multiple boreholes in response to an axial force.

2. The diverter assembly of claim 1 further including a locking assembly disposed between the mandrel and the outer housing to release the mandrel from the outer housing in response to the axial force.

3. The diverter assembly of claim 1 further including a lower connector releasably engaged with the diversion housing.

4. The diverter assembly of claim 3 wherein the lower connector includes a latching assembly for coupling with an installed downhole device.

5. The diverter assembly of claim 4 wherein the latching assembly is shearable to release the diverter assembly from the installed downhole device.

6. The diverter assembly of claim 3 wherein the outer housing includes an upper receptacle, and the lower connector and upper receptacle form a chamber in the outer housing, wherein the mandrel is slidable and rotatable in the chamber.

7. The diverter assembly of claim 6 further including a spring biasing the mandrel and diversion housing toward the lower connector, and wherein the mandrel is configured to receive an actuation tool to raise the mandrel against the biasing spring.

8. The diverter assembly of claim 1 wherein an actuation tool received by the mandrel provides the axial force.

9. The diverter assembly of claim 8 wherein the actuation tool and the mandrel are configured to engage during multiple entries of the actuation tool into the mandrel.

10. The diverter assembly of claim 1 wherein a biasing spring disposed between the mandrel and the outer housing provides the axial force.

11. The diverter assembly of claim 1 wherein the diversion housing includes a diverter member disposed at an opening of one of the first and second passages, wherein the diverter member includes reduced width blades for allowing fluid to flow therethrough.

12. The diverter assembly of claim 11 wherein the diversion housing includes a roller and a funnel recess disposed between the first and second passages.

13. The diverter assembly of claim 1 wherein the indexing mechanism includes a pin and guide slot arrangement.

14. A rotary diverter assembly for selectively aligning with multiple boreholes comprising:

an outer housing having an upper receptacle and a lower connector;

a mandrel disposed in the outer housing between the upper receptacle and the lower connector, the mandrel including a diversion housing having separate and pre-defined adjacently disposed first and second passages; and an indexing mechanism disposed between the mandrel and the outer housing; wherein the mandrel is axially moveable between the upper receptacle and the lower connector and rotatable in response to the axial movement via the indexing mechanism.

15. The diverter assembly of claim 14 wherein the mandrel is configured to receive and engage an actuation tool to axially move the mandrel.

16. The diverter assembly of claim 15 wherein the actuation tool includes outer shoulders on collets that engage inner shoulders of the mandrel.

17. The diverter assembly of claim 16 wherein the shoulder engagement between the actuation tool and the mandrel releases a locking mechanism between the mandrel and the upper receptacle.

18. The diverter assembly of claim 15 wherein axial movement of the mandrel by the actuation tool is opposed by a biasing spring.

19. The diverter assembly of claim 14 wherein the lower connector includes a releasable latching assembly for coupling with an installed downhole device.

20. A method for selectively aligning a rotary diverter assembly with multiple boreholes comprising:

lowering the diverter assembly into a well;

aligning the diverter assembly on an installed downhole device;

latching the diverter assembly into the installed downhole device to position the diverter assembly in a junction between a main borehole and a lateral borehole, wherein a first passage of the diverter assembly is aligned with the lateral borehole and a separate and pre-defined adjacently disposed second passage of the diverter assembly is aligned with the main borehole;

performing a downhole operation in the lateral borehole through the first passage;

axially moving a mandrel including the first and second passages;

rotating the mandrel and the first and second passages with an indexing mechanism in response to the axially moving; and re-aligning the first passage with the main borehole and the second passage with the lateral borehole.

21. The method of claim 20 wherein axially moving the mandrel includes biasing the mandrel and opposing the biasing using an actuation tool engaged with the mandrel.

22. The method of claim 20 wherein axially moving the mandrel includes releasing a locking mechanism between the mandrel and an outer housing.

23. The method of claim 20 further comprising:

performing a downhole operation in the main borehole through the first passage;

axially moving the mandrel including the first and second passages;

rotating the mandrel and the first and second passages with the indexing mechanism in response to the axially moving; and re-aligning the first passage with the lateral borehole and the second passage with the main borehole.

24. The method of claim 20 further comprising releasing a latching assembly and retrieving the diverter assembly from the well.

25. The method of claim 20 wherein all steps are executed during a single trip into the well.

* * * * *